US006188862B1

(12) United States Patent
Ishii

(10) Patent No.: US 6,188,862 B1
(45) Date of Patent: Feb. 13, 2001

(54) IMAGE FORMING APPARATUS PREVENTING TONER ADHESION ONTO TRANSFER MEMBER

(75) Inventor: Hirokazu Ishii, Tokyo (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/511,914

(22) Filed: Feb. 23, 2000

(30) Foreign Application Priority Data

Feb. 23, 1999 (JP) ..... 11-045561
Jul. 29, 1999 (JP) ..... 11-215968

(51) Int. Cl.[7] ..... G03G 15/16
(52) U.S. Cl. ..... 399/313; 399/303
(58) Field of Search ..... 399/302, 313, 399/312, 297, 303

(56) References Cited

U.S. PATENT DOCUMENTS 5,172,173 * 12/1992 Goto et al. ..... 399/312
5,631,725 5/1997 Harasawa et al. .
5,822,667 * 10/1998 Hayama et al. ..... 399/313 X
5,995,793 * 11/1999 Enomoto et al. ..... 399/302

FOREIGN PATENT DOCUMENTS 6-161295 * 6/1994 (JP) .
8-185060 * 7/1996 (JP) .
8-278707 * 10/1996 (JP) .
8-305181 * 11/1996 (JP) .
8-328312 * 12/1996 (JP) .
11-288186 * 10/1999 (JP) .

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus includes an image carrier and a transfer device arranged in contact with or in proximity to the image carrier to transfer a toner image on the image carrier onto a transfer medium. The transfer device includes an endless transfer member, a cleaning device to clean the endless transfer member, and an electrode to apply a transfer bias onto the endless transfer member. The endless transfer member has a configuration in which a surface coat layer is formed on a substrate made of an elastic material, and a crack occurring elongation percentage of the surface coat layer is larger than 20%.

72 Claims, 10 Drawing Sheets

IMAGE FORMING APPARATUS PREVENTING TONER ADHESION ONTO TRANSFER MEMBER

BACKGROUND OF THE INVENTION

1. Field of the Invention

The present invention relates to image forming apparatuses using an electrostatic transfer method, such as copy machines, printers or facsimile machines. More particularly, the present invention relates to an image forming apparatus which prevents adhesion of toner or paper powder to the surface of a transfer member for transferring a toner image on a photosensitive member onto a transfer medium such as a transfer paper or an OHP sheet and which thereby prevents the resultant decrease in image quality and contamination of the back of the transfer medium.

2. Discussion of the Background

In image forming apparatuses using an electrostatic transfer method, such as copy machines, printers or facsimile machines, an electrostatic latent image is formed by exposing a photosensitive member (image carrier) previously charged uniformly with optical image information such as reflected light from an original document, and the electrostatic latent image is developed with toner supplied from a developing unit. The resultant toner image is transferred onto a transfer medium by a transfer unit and the transferred image is fixed onto the transfer medium by a fixing unit.

Two types of transfer units are known, a corona transfer type and a contact transfer type. In a corona transfer type transfer unit, a surface of a photosensitive member directly faces a corona charging device, and electrostatic transfer is accomplished by applying a charge of an inverted polarity to that of a toner image carried on the photosensitive member, through corona discharge, to a transfer medium passing through the gap between the corona charging unit and the photosensitive member. In a contact transfer type transfer unit, a bias roller serving as a transfer device faces a photosensitive member via an endless transfer belt made of a material having a certain electric resistance, and a toner image is transferred from the photosensitive member onto a transfer medium by applying a transfer bias to the bias roller when the transfer medium carried by the transfer belt is transported to a transfer position. The transfer belt having a certain electrical resistance has a surface coat layer having a prescribed elongation percentage (for example, a layer coated by a coating material using fluorine) formed on an elastic substrate made of, for example, EPDM and chloroprene or singly chloroprene.

A contact transfer type transfer unit in which a transfer belt is used and a bias is applied onto the transfer belt has advantages of a small amount of generated ozone, a small capacity of power supply, and a satisfactory separating and transporting performance of the transfer medium.

However, the contact transfer type transfer unit using a transfer belt has a problem in the cleaning performance of the transfer belt. More specifically, residual toner remaining on a surface of the photosensitive member or toner floating within the apparatus tends to easily adhere onto the transfer belt electrostatically or under a contact pressure, and the toner adhering onto the transfer belt causes back contamination of a transfer medium transported on the transfer belt. Further, in the contact transfer type transfer unit, the heat of the photosensitive member is transferred to the transfer belt due to the contact between the transfer belt and the photosensitive member and thereby the surface temperature of the belt is increased. As a result, the toner firmly adheres to the transfer belt, making it difficult to remove. This phenomenon is known as toner adhesion.

Such toner adhesion to the transfer belt causes defective separation of a transfer medium from the transfer belt, resulting in jamming of the transfer medium and wear of the cleaning blade edge. Further, the toner adhering to the transfer belt moves back onto the surface of the photosensitive member and causes a decrease in the quality of the transferred image. Furthermore, in a machine mounting a charging roller, the toner having moved from the transfer belt to the photosensitive member adheres to the charging roller, which may cause unstable charging potential or an unstable image forming process. If toner penetrates into fine cracks of the transfer belt, the toner penetrated into the fine cracks cannot be sufficiently cleaned with a cleaning device for the transfer belt, resulting in accumulation of the toner in the cracks of the transfer belt. As a result, defective separation of a transfer medium from the transfer belt and resulting jamming of the transfer medium, and wear of the cleaning blade edge may be caused.

The transfer belt may be further contaminated by paper powder produced from the transfer medium. Paper powder adheres to the transfer belt, penetrates into the fine cracks on the belt surface and accumulates there, and so is difficult to remove with the cleaning device for the transfer belt. Such accumulation of paper powder may cause accumulation or adhesion of toner around the paper powder. Further, entanglement and adhesion of paper powder at the edge of the cleaning blade tends to decrease cleaning performance of the cleaning device, resulting in leaving residue of toner on the transfer belt.

In an apparatus using recycled toner, because of the properties of the recycled toner, it is difficult to remove the recycled toner adhering to a transfer belt, resulting in a very poor cleaning performance of the transfer belt.

Toner or paper powder adhering to a transfer belt is generally removed with a cleaning device such as a cleaning blade rubbing the surface of the transfer belt. Various methods are proposed for improving the cleaning performance of a cleaning device or preventing back contamination of a transfer medium.

For example, Japanese Laid-open Patent Publication No. 8-278707 proposes an image forming apparatus having a lubricant feeding member feeding a lubricant onto the surface of a transfer member for improving the cleaning performance of the transfer member by reducing frictional coefficient of the surface of the transfer member, and an image forming apparatus having a lubricant feed device feeding a lubricant onto a photosensitive member so that the lubricant fed onto the photosensitive member is coated onto the surface of the transfer member.

Japanese Laid-open Patent Publication No. 8-185060 proposes a transfer/transport belt apparatus, in which a foaming film layer is formed on the surface of a transfer belt so that toner is collected inthe foam cells of the foaming film layer, thus preventing back contamination of a transfer medium.

Japanese Laid-open Patent Publication No. 8-305181 proposes a transfer/transport apparatus in which the thickness of a surface coat layer of a transfer belt is made smaller than the toner particle diameter for preventing defective cleaning of the surface of the transfer belt so that, even when cracks are produced in the surface coat layer of the transfer belt, toner particles do not penetrate into the cracks and can easily be scraped off with a cleaning device (cleaning blade).

However, when coating a lubricant onto the surface of a transfer member, as is disclosed in the aforementioned Japanese Laid-open Patent Publication No. 8-278707, coating blurs of the lubricant tend to occur, and cleaning blurs may be caused by coating blurs of the lubricant. Further, even when the aforementioned lubricant is coated, if cracks occur in the transfer member, a satisfactory cleaning performance may not be made.

When a foamed film layer is formed on the surface of a transfer belt as is disclosed in the aforementioned Japanese Laid-open Patent Publication No. 8-185060, toner adhesion may be caused by accumulation of toner in the foam cells of the foamed film layer.

Further, even when the thickness of a surface coat layer of a transfer belt is made smaller than the particle diameter of toner, as is disclosed in Japanese Laid-open Patent Publication No. 8-305181, toner may be accumulated in the cracks of the transfer belt, and so toner adhesion may occur.

In an image forming apparatus in which a contact transfer type transfer device using a transfer belt is used, therefore, it is very important to improve the cleaning performance of an endless transfer member such as a transfer belt. More specifically, it is desired that the performance of removing toner and paper powder adhering onto the endless transfer member is improved, so that back contamination of a transfer medium is reduced.

SUMMARY OF THE INVENTION

The present invention has been made in view of the above-discussed and other problems, and addresses the above-discussed and other problems.

Preferred embodiments of the present invention provide an image forming apparatus which eliminates accumulation and adhesion of contamination such as toner and paper powder on an endless transfer member of a transfer device transferring a toner image on an image carrier to a transfer medium by improving the surface properties of a surface coat layer forming the surface of the transfer member of the transfer device.

The present invention is applicable, not only to an endless belt-like shaped transfer member but also to a roller-like shaped transfer member for transferring a toner image from an image carrier to a transfer medium. The present invention is further applicable to an endless intermediate transfer member for transferring thereupon a toner image carried on an image carrier or a sheet transporting member to transport a transfer sheet thereupon.

According to a preferred embodiment of the present invention, a novel image forming apparatus includes an image carrier and a transfer device arranged in contact with or in a proximity of the image carrier to transfer a toner image on the image carrier onto a transfer medium. The transfer device includes an endless transfer member, a cleaning device to clean the endless transfer member, and an electrode to apply a transfer bias onto the endless transfer member. The endless transfer member has a configuration in which a surface coat layer is formed on a substrate made of an elastic material, and a crack occurring elongation percentage of said surface coat layer is larger than 20%.

According to another preferred embodiment of the present invention, the endless transfer member is a belt having a configuration in which a surface coat layer is formed on a substrate made of an elastic material, and a relationship between a crack occurring elongation percentage of the surface coat layer of the belt and an elongation percentage of the surface coat layer when the belt is stretched around a group of rollers satisfies a condition expressed by: (the crack occurring elongation percentage)>(the elongation percentage when the belt is stretched)×5.

According to still another embodiment of the present invention, the endless transfer member is a belt having a configuration in which a surface coat layer is formed on a substrate made of an elastic material and the surface coat layer includes an outermost layer and at least one intermediate layer, and at least one of a first condition that a crack occurring elongation percentage of the outermost layer of the belt is larger than 20% and a second condition that a relationship between the crack occurring elongation percentage of the outermost layer of the belt and an elongation percentage of the outmost layer when the belt is stretched around a group of rollers satisfies a condition expressed by: (the crack occurring elongation percentage)>(the elongation percentage when the belt is stretched)×5 is satisfied.

According to still another embodiment of the present invention, the endless transfer member is a belt having a configuration in which a surface coat layer is formed on a substrate made of an elastic material and the surface coat layer includes an outermost layer and at least one intermediate layer. The crack occurring elongation percentage of said outermost layer is in a range from 8% to 20%, and further, at least one of a first condition that a crack occurring elongation percentage of said at least one intermediate layer is larger than 20% and a second condition that a relationship between the crack occurring elongation percentage of said at least one intermediate layer and an elongation percentage of said at least one intermediate layer when the belt is stretched around a group of rollers satisfies a condition expressed by (the crack occurring elongation percentage)>(the elongation percentage when the belt is stretched)×5 is satisfied.

According to still another embodiment of the present invention, the endless transfer member is a belt having a configuration in which a surface coat layer is formed on a substrate made of an elastic material and the surface coat layer includes an outermost layer and at least one intermediate layer. The relationship between the crack occurring elongation percentage of the outermost layer and an elongation percentage of the outermost layer when the belt is stretched around a group of rollers satisfies a condition expressed by (the elongation percentage when the belt is stretched)×2≦(the crack occurring elongation percentage)≦(the elongation percentage when the belt is stretched)×5, and further, at least one of a first condition that a crack occurring elongation percentage of the at least one intermediate layer is larger than 20% and a second condition that an elongation percentage of the intermediate layer when the belt is stretched around a group of rollers satisfies a condition expressed by (the crack occurring elongation percentage)>(the elongation percentage when the belt is stretched)×5 is satisfied.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments of the present invention will now be described with reference to the drawings.

Figure 1:
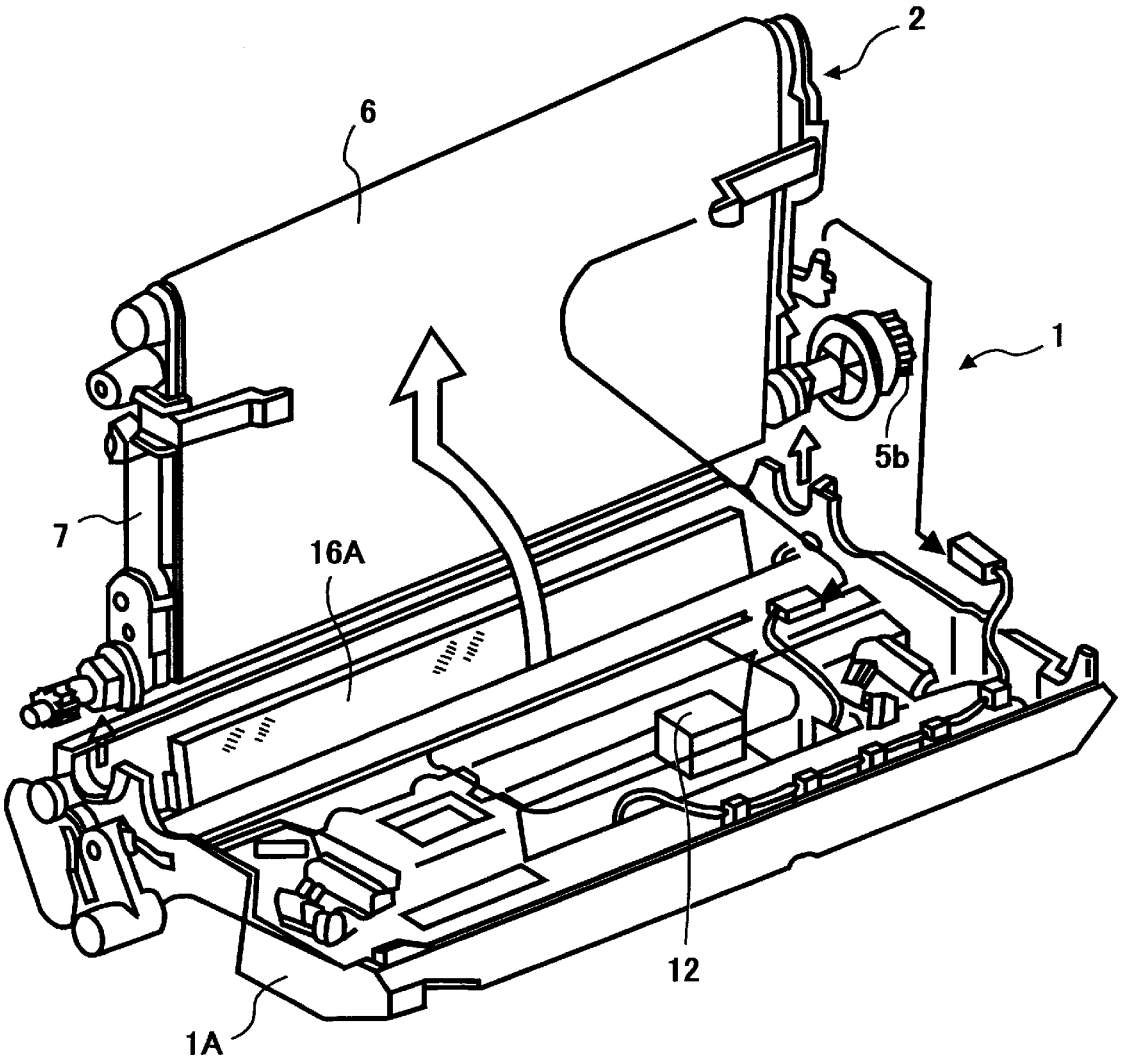
FIG. 1 is a perspective view of a transfer transport unit using a transfer belt according to an embodiment of the present invention.
Figure 2:
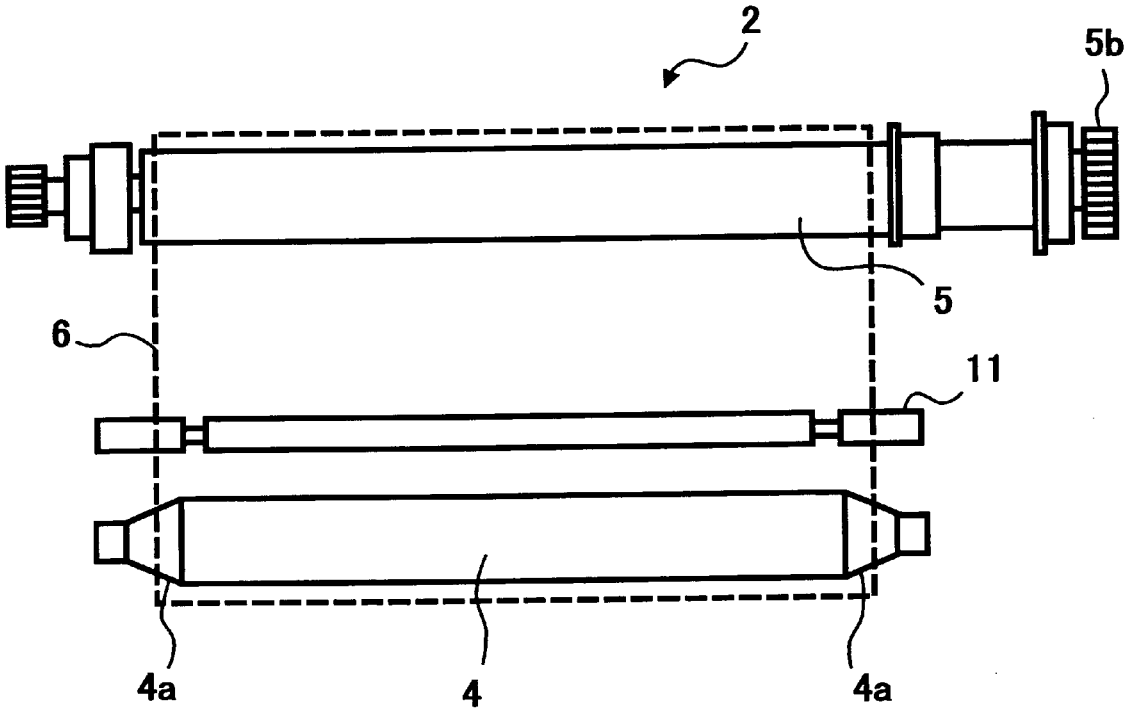
FIG. 2 is a plan view illustrating a configuration of the transfer transport unit illustrated in FIG. 1.
Figure 3:
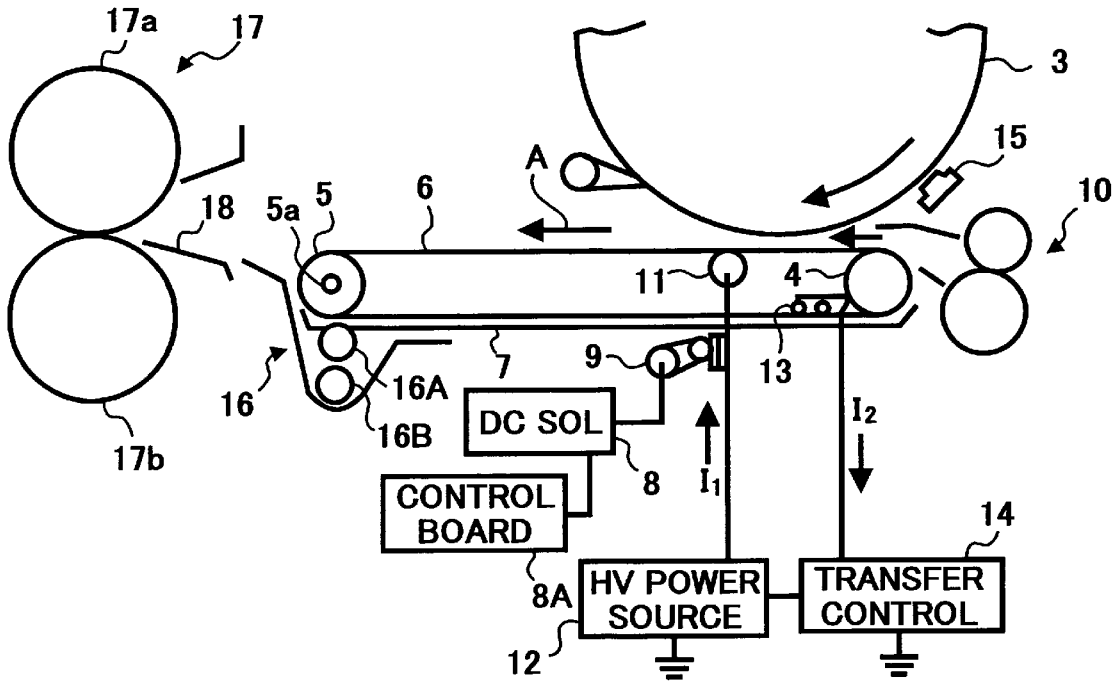
FIG. 3 is a schematic diagram illustrating a configuration of an image forming apparatus using the transfer transport unit of FIG. 1.
Figure 4:
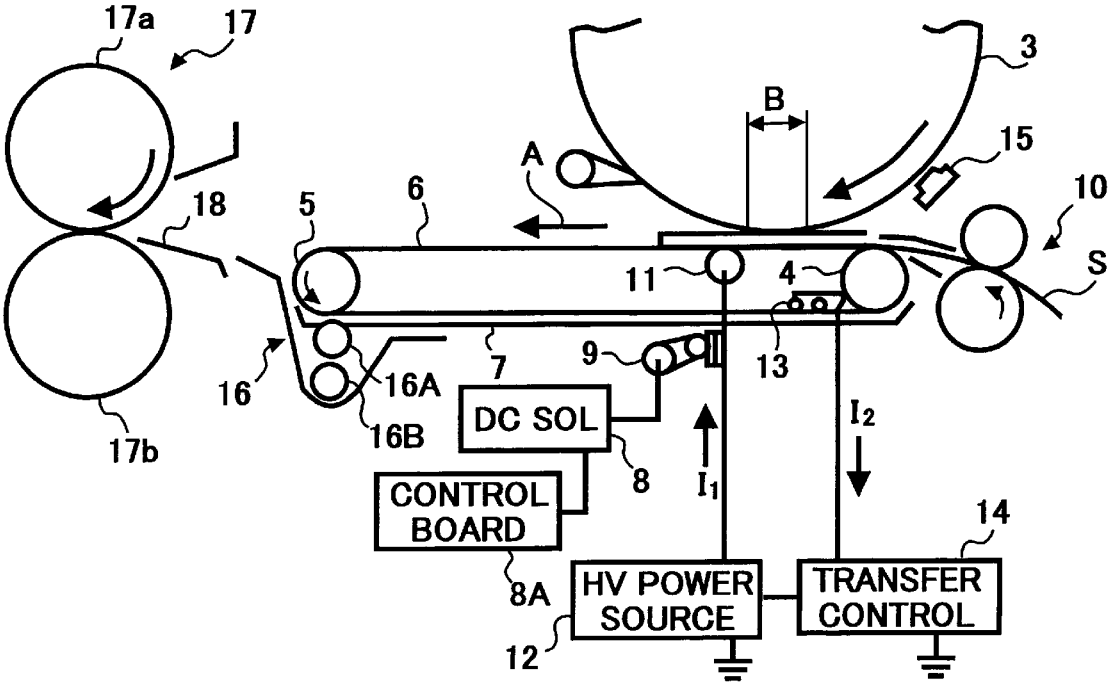
FIG. 4 is a schematic diagram of the image forming apparatus of FIG. 3 when an image transfer operation is performed.

FIG. 1 is a perspective view of a transfer transport unit of an image forming apparatus using a transfer belt as the transfer medium carrier according to an embodiment of the present invention; FIG. 2 is a plan view schematically illustrating a configuration of the transfer transport unit illustrated in FIG. 1; FIG. 3 is a schematic diagram illustrating a construction of the image forming apparatus; and FIG. 4 is a schematic diagram of the image forming apparatus when a transfer operation is performed.

In a transfer transport unit 1 illustrated in FIG. 1, a belt unit 2 is detachably supported by a main body 1A. The belt unit 2 is provided with a transfer belt 6 serving as a belt-shaped transfer medium carrier on which a transfer medium such as a transfer sheet is carried so as to be transported, and a toner image formed on a drum-shaped photosensitive member 3 serving as the image carrier (illustrated in FIG. 3) is transferred onto the transfer medium. The transfer belt 6 is stretched over a driving roller 5 and a follower roller 4 as supporting members supporting the transfer belt 6. The belt unit 2 includes, as illustrated in FIG. 3, a DC solenoid 8 and a contact-separation lever 9 for contacting/separating the transfer belt 6 with and from the photosensitive member 3, a bias roller 11 serving as a transfer charge applying device for applying a transfer charge by applying a transfer bias onto the transfer belt 6, a contact plate 13 for removing the charge of the transfer belt 6, and a belt cleaning unit 16 for cleaning the transfer belt 6 by removing toner or paper powder adhering to the surface of the transfer belt 6. A high-voltage power source 12 applying a voltage onto the body 1A illustrated in FIG. 1. The driving roller 5 has a gear 5*b* connected to a driving motor (not shown) at an end thereof so as to be rotated, as illustrated in FIGS. 1 and 2.

Figure 5:
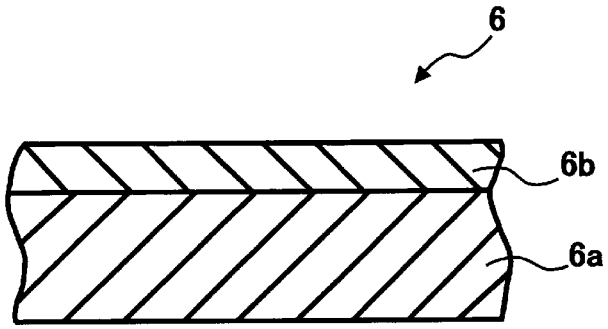
FIG. 5 is a sectional view of a transfer belt used in the transfer transport unit of FIG. 1.

In FIG. 3, the transfer belt 6 is rotated with the rotation of the driving roller 5 so as to move in the transporting direction (arrow A direction) of a transfer sheet S serving as transfer medium at a position opposite to the photosensitive member 3. The transfer belt 6 has a dual-layer structure including a base layer 6*a* and a surface coat layer 6*b* as illustrated in FIG. 5. The values of the electric resistance of the transfer belt 6 as measured in accordance with JIS K6911 are set such that, when DC 100 V is applied, a surface resistivity of the surface coat layer 6*b* is within a range of from $1\times10^{8}$ Ω to $1\times10^{12}$ Ω, a surface resistivity of the base layer 6*a* is within a range of from $1\times10^{7}$ Ω to $1\times10^{9}$ Ω, and a volume resistivity is within a range of from $5\times10^{8}$ Ω.cm.

The values presented above as the resistance of the transfer belt 6 are only examples.

As the material for the transfer belt 6, it is desirable to add carbon and zinc oxide in appropriate amounts as conductive materials controlling the resistance of the transfer belt 6. When using a rubber belt as the elastic belt, it is desirable to select a material having a low hygroscopicity and a stable resistance value such as chloroprene rubber, EPDM rubber, silicone rubber or epichlorohydrin rubber. The material is not however limited to those presented above. As the material for the surface coat layer 6*b*, for example, a fluorine-based coating material mainly including fluorine is used. The material for the surface coat layer 6*b* is not however limited to such material.

The follower roller 4 and the driving roller 5 are rotatably supported by a support 7, as illustrated in FIGS. 1 and 3. The support 7 is configured to swingtoward or away from the photosensitive member 3 around a supporting shaft 5*a* of the driving roller 5 positioned downstream of a transfer position relative to the photosensitive member 3 in the transporting direction of the transfer sheet S as represented by the arrow A in FIG. 3. The support 7 is pressed by a contact/separation lever 9 which is driven to press the support 7 by the DC solenoid 8 according to a signal from a control board 8A and is returned by gravity or by a spring force. Thus, the contact/separation lever 9 acts to bring the transfer belt 6 into contact with the surface of the photosensitive member 7 or to separate the transfer belt 6 from the photosensitive member 7.

In other words, when a leading end of a transfer sheet S transported in a state aligned with a leading end of a toner image formed on the photosensitive member 3 by a registration roller pair 10 serving as a transfer sheet transporting device approaches the photosensitive member 3, a driving signal is outputted from the control board 8A to drive the DC solenoid 8. The support 7 approaches the photosensitive member 3 by the driving action of the solenoid 8 to bring the transfer belt 6 into contact with the photosensitive member 3, thus forming a transfer nip section B capable of transporting the transfer sheet S while keeping the sheet S in contact with the photosensitive member 3 at a position opposite the photosensitive member 3.

The roller 4 located at the photosensitive member 3 side serves as a follower roller relative to the roller 5 serving as the driving roller. The surface of this follower roller 4 is shaped, as illustrated in FIG. 2, such that both ends 4*a* taper in the axial direction to prevent deviation of the transfer belt 6 to one side. The follower roller 4 is a conductive roller made of a metal, and only supports the transfer belt 6 having the electric resistance values as described above and is not electrically connected directly to any other conductive member. The follower roller 4 may also be grounded, like the contact plate 13 described later, by feeding back to the high-voltage power source 12. The material for the driving roller 5 should preferably be selected from EPDM rubber, chloroprene rubber and silicone rubber to ensure the gripping force for the transfer belt 6 when the driving roller 5 is driven. A conductive metal roller is also applicable for the driving roller 5 in place of a rubber roller. The feedback current from the driving roller 5 may be also fed back to the high-voltage power source 12.

The bias roller 11 is in contact with the inside of the transfer belt 6 downstream (left side in FIGS. 3 and 4) of the follower roller 4 in the moving direction of the transfer belt 6. The bias roller 11 serves as a contact electrode for applying a charge of an inverted polarity to the charge polarity of the toner T on the photosensitive member 3 to the transfer belt 6, and is connected to the high-voltage power source 12. In this embodiment, toner T of positive polarity is employed, and therefore the transfer bias has a negative polarity.

The contact plate 13 is arranged so as to be in contact with the inner surface of a part of the belt 6 at the lower side of the belt unit 2, i.e., a part of the belt 6 not transporting a transfer sheet S, near the follower roller 4. With this arrangement of the contact plate 13, injection of charge into the transfer sheet S upstream of the transfer nip section B is prevented as described later. Further, the contact plate 13 detects the current flowing on the transfer belt 6 as a feedback current, and the current fed from the bias roller 11 is controlled according to the feedback current. For this control, a transfer control board 14 for setting a current to be supplied to the bias roller 11 in response to the detected feedback current is connected to the contact plate 13 and the transfer control board 13 is connected to the high-voltage power source 12.

In the above-described transfer transport unit 1, as illustrated in FIG. 4, the support 7 is set to a posture bringing the transfer belt 6 closer to the photosensitive member 3 in response to feeding of the transfer sheet S from the registration roller 10, such that the transfer nip section having a width of 4 to 8 mm for the length of the transfer sheet S in the transporting direction A is formed in the gap between the photosensitive member 3 and the transfer belt 6.

Figure 6:
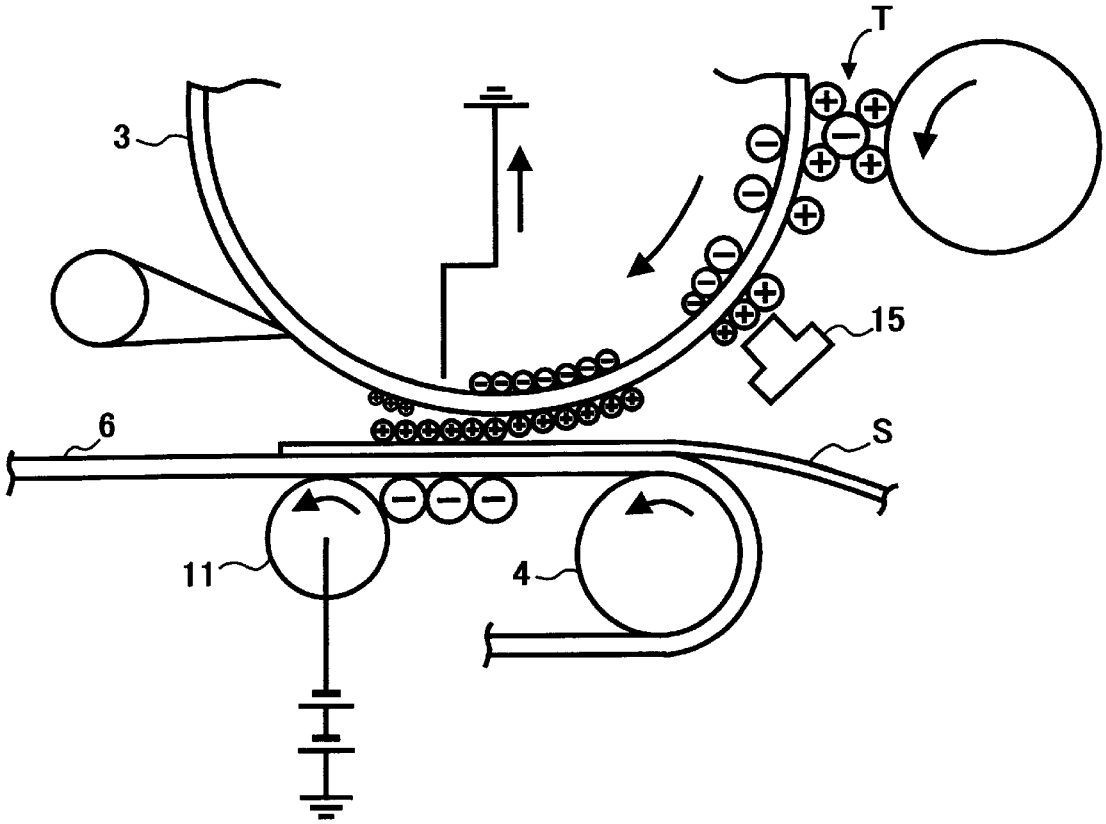
FIG. 6 is a descriptive view illustrating the transfer operation of toner particles in the transfer transport unit illustrated in FIG. 1.

On the other hand, the surface of the photosensitive member 3 charged with, for example −800 V, and electrostatically attracting thereupon toner T of positive charge (as illustrated in FIG. 6), moves to the transfer nip section B. Before reaching the transfer nip section B, the surface potential of the photosensitive member 3 is decreased by a pre-transfer discharge lamp (PTL) 15 arranged near the photosensitive member 3 which decreases the charge of the surface of the photosensitive member 3. In FIG. 6, the intensity of charge is represented by the size of circles: the charge reduced by the pre-transfer discharge lamp 15 is indicated by a circle smaller than that representing the charge before being reduced by the pre-charge discharge lamp 15.

At the transfer nip section B illustrated in FIG. 4, the toner T on the photosensitive member 3 is transferred onto the transfer sheet S under the effect of the transfer bias from the bias roller 11 located at the transfer belt 6 side. The transfer bias within a range of from −1.5 kV to −6.5 kV is applied from the high-voltage power source 12 because the transfer bias is set variable as a result of a constant-voltage control described later. More specifically, in FIGS. 3 and 4, when the output current value from the high-voltage power source 12 is represented by $I_1$ and the value of the detected feedback current flowing from the contact plate 13 toward the grounding side via the transfer belt 6 is represented by $I_2$, the value of $I_1$ is controlled so as to satisfy the following relationship:

$$I_1 - I_2 = I_{out} \text{(where, } I_{out}\text{:constant).}$$

The purpose of the above-described control is to eliminate a change in the transfer efficiency by stabilizing the surface potential Vp on the transfer sheet S irrespective of a change in the environmental conditions such as temperature and humidity, or fluctuations in the manufacturing quality of the transfer belt 6. That is, by assuming the current flowing toward the photosensitive member 3 side through the transfer belt 6 and the transfer sheet S to be $I_{out}$, a change in the flowability of current to the transfer belt 6 caused by a decrease or an increase in the surface resistance of the transfer belt 6 is prevented from exerting an influence on the separating function or the transfer performance of the transfer sheet S. In this embodiment, satisfactory transfer was obtained with a setting of $I_{out}$=35 $\mu$A±5 $\mu$ under conditions of a transporting speed of the transfer belt at 330 mm/sec and an effective bias roller length of 310 mm.

When a toner image is transferred from the photosensitive member 3 to a transfer sheet S, the transfer sheet S is also charged at the same time. Therefore, the transfer sheet S is electrostatically attracted onto the transfer belt 6 and the transfer sheet S is separated from the photosensitive member 3 under the effect of the relationship between the true electric charge of the transfer belt 6 and the polarized charge produced at the transfer sheet S side. This separation of the transfer sheet S from the photosensitive member 3 is accelerated by the peeling action of the transfer sheet S caused by the strong tension of the transfer sheet S itself by utilization of curvature separation of the photosensitive member 3.

Separation of the transfer sheet S from the photosensitive member 3 by electrostatic attraction as described above cannot be smoothly performed, however, depending upon the environmental conditions. For example, at high temperatures, current tends to easily flow through the transfer sheet S and as a result, the transfer sheet S cannot be smoothly separated from the photosensitive member 3. To avoid such inconvenience, because the resistance value of the surface coat layer 6*b* of the transfer belt 6 is set relatively high, there is provided a delay in the application of the true electric charge from the transfer belt 6 to the transfer sheet S at the transfer nip section B, and further the bias roller 11 is located downstream of the transfer nip section B in the transfer sheet transporting direction. With this arrangement, the electrostatic attracting relationship between the transfer sheet S and the photosensitive member 3 is avoided and thereby charging the transfer sheet S does not occur upstream of the transfer nip section B up to the moment when the transfer sheet S reaches the transfer nip section B. It is consequently possible to prevent the transfer sheet S from being wound on the photosensitive member 3, and thereby defective separation of the transfer sheet S from the photosensitive member 3 is prevented.

As the transfer belt 6, a material in which the resistance does not greatly change due to a change in the environment is preferable. As the conductive materials for controlling the resistance of the transfer belt 6, an appropriate amount of carbon and zinc oxide is preferably added. When using an elastic belt (rubber belt) as the transfer belt 6, it is desirable to select a material low in the hygroscopicity and stable in the resistance value such as chloroprene rubber, EPDM rubber, silicone rubber or epichlorhydrine rubber. The value of the current $I_{out}$ flowing to the photosensitive member 3 side can be reduced, for example, when the transporting speed is low, and increased when the transporting speed is high or when a pre-transfer discharging lamp 15 is not used.

The transfer sheet S having passed through the nip section B is transported along with the movement of the transfer belt 6 while being electrostatically attracted to the transfer belt 6, and is separated from the transfer belt 6 by the curvature separation function of the roller 5. For this curvature separation, the diameter of the driving roller 5 is set smaller than about 16 mm. The result of an experiment using such a driving roller 5 has demonstrated that a sheet of high-grade 45K paper (rigidity: transversely 21 [$cm^3$/100]) can be separated.

The transfer sheet S separated from the transfer belt 6 at an outer peripheral position of the driving roller 5 is guided by a guide plate 18 and transported to a gap between a heating roller 17*a* and a pad roller 17*b* forming a fixing section 17. In the fixing section 17, the toner on the transfer sheet S is melted by heating and is pressed against the transfer sheet S and thereby fixed onto the transfer sheet S.

After the completion of the image transfer onto the transfer sheet S and the separation of the transfer sheet S from the transfer belt 6, the contact/separation lever 9 moves in the retreating direction in response to the release of magnetic excitation of the DC solenoid 8, and thereby the support 7 is separated from the photosensitive member 3. Then, the surface of the transfer belt 6 is cleaned by the cleaning unit 16.

The cleaning unit 16 has a cleaning blade 16A, and toner or paper powder of the transfer sheet S adhering to the transfer belt 6 is scraped off the transfer belt 6 by rubbing the surface of the transfer belt 6 with the cleaning blade 16A.

Because the transfer belt 6 is rubbed by the cleaning blade 16A, for preventing an increase in the frictional resistance between the belt 6 and the cleaning blade 16A and a resulting increase in the driving force or tearing of the cleaning blade 16A, the transfer belt 6 has a surface coat layer 6*b* made of a fluorine-based resin material having the low frictional coefficient, such as polyvinylidene fluoride or ethylene tetrafluoride. The toner or paper powder scraped off from the surface of the transfer belt 6 is collected by a collecting screw 16B and is conveyed into a waste toner collecting container (not shown).

Now, the configuration of the transfer belt 6 will be described.

As described later, for improving the cleaning performance of the transfer belt 6 so that toner or paper powder is prevented from adhering to the transfer belt 6, the transfer belt 6 has a surface coat layer 6*b* on the base layer 6*a* of the transfer belt 6, in which cracks do not occur in the surface thereof, or cracks having a width longer than a prescribed width do not occur in the surface thereof, when the transfer belt 6 is stretched around the above-described follower roller 4 and the driving roller 5.

EXAMPLE 1

In example b 1, a surface coat layer 6*b* having a good elongation percentage is used. Specifically, the surface coat layer 6*b* has an elongation percentage where a crack starts to occur in the surface of the surface coat layer 6*b* larger than 20%; that is, cracks will not occur in the surface coat layer until the surface coat layer has been stretched by at least 20%. An elongation percentage of the transfer belt 6 where a crack starts to occur in the surface of the transfer belt 6 supporting a transfer sheet S thereupon is hereinafter referred to as the crack occurring elongation percentage. A higher crack occurring elongation percentage permits a greater stretch of the transfer belt 6 cracks occurring in the surface of the transfer belt 6.

Table 1 shows the result of an experiment carried out on various transfer belts 6 in the aforementioned image forming apparatus to investigate the relationship between the crack occurring elongation percentage of the transfer belt 6 and presence of toner adhesion on the transfer belt 6.

TABLE 1

| elongation percentage | cleaning performance |
|---|---|
| 5 | X |
| 7 | Δ |
| 8 | ○ |
| 10 | ○ |
| 15 | ○ |
| 20 | ○ |
| 25 | ◎ |
| 30 | ◎ |

In the column of cleaning performance in Table 1, "◎" represents non-occurrence of toner adhesion with an elapse of time (i.e., even after 240,000 copies were made); "○" represents non-occurrence of toner adhesion while 240,000 copies were made; "Δ" represents occasional occurrence of toner adhesion while 240,000 copies were made, and "X" represents occurrence of toner adhesion from the start of making copies.

When measuring the elongation percentage of the surface coat layer 6*b* of the transfer belt 6 upon occurrence of a crack, it is difficult to measure the elongation of the surface coat layer 6*b* alone. In practice, therefore, in a state in which the surface coat layer 6*b* is provided on a base layer 6*a* as a substrate for the transfer belt 6, the base layer 6*a* is stretched and the elongation percentage of the base layer 6*a* when a crack has occurred in the surface coat layer 6*b* is measured. Since the base layer 6*a* serving as the substrate is highly elastic, the thus measured elongation percentage of the surface coat layer 6*b* upon occurrence of a crack is equal to that measured on the surface coat layer 6*b* alone.

This example is characterized in that occurrence of cracks in the surface of the surface coat layer 6*b* and toner adhesion to the surface of the surface of the transfer belt 6 are prevented by using a material having a good elongation, i.e., a large crack occurring elongation percentage, for the surface coat layer 6*b* of the transfer belt 6.

The elongation percentage of the surface coat layer 6*b* of the transfer belt 6 can be adjusted by adding a hardening agent to the fluorine-based resin material forming the main constituent of the surface coat layer 6*b*. As shown in Table 1, a material having a lower value of crack occurring elongation percentage leads to a more fragile surface coat layer 6*b*, and when stress is applied to the transfer belt 6 from the other members when the transfer belt 6 is mounted in an apparatus, cracks tend to be easily produced in the surface coat layer 6*b*. In other words, the surface coat layer 6*b* having a smaller value of crack occurring elongation percentage results in earlier occurrence of cracks in the surface coat layer 6*b*. A high crack occurring elongation percentage of the surface coat layer 6*b* corresponds to a better stretching property of the surface coat layer 6*b*, and it is more difficult for cracks to occur in the surface coat layer 6*b* having a high crack occurring elongation percentage.

As is evident from Table 1, toner adhesion to the transfer belt 6 occurs when the crack occurring elongation percentage of the surface coat layer 6*b* is smaller than 8%, and when the crack occurring elongation percentage of the surface layer 6*b* is at least 8% and larger, toner adhesion to the transfer belt 6 does not occur. Further, toner adhesion to the transfer belt 6 does not occur over time when the crack occurring elongation percentage of the transfer belt 6 is at least 25% or larger.

When toner adhesion occurring over time is considered, the crack occurring elongation percentage of the transfer belt 6*b* is preferably at least 20% or larger. In example 1, therefore, the crack occurring elongation percentage of the surface coat layer 6*b* is larger than 20%, and thereby it is possible to prevent toner adhesion to the transfer belt 6 over time, and prevent such inconveniences as a decrease in the separating performance of the transfer sheet S, occurrence of jamming of the transfer sheet S, and a decrease in the image quality caused by toner adhesion to the transfer belt 6

Although the crack occurring elongation percentage of the surface coat layer 6*b* is preferably larger than 20%, this does not imply that a material having a crack occurring elongation percentage within a range of from 8 to 20% is not totally applicable. A material having a crack occurring elongation percentage of about 20%, and particularly within a range of from 20 to 25%, is well applicable to practical uses.

EXAMPLE 2

Table 1 shows the relationship between the elongation property, i.e., the crack occurring elongation percentage, of the transfer belt 6 itself and presence of toner adhesion to the transfer belt 6. When the transfer belt 6 is mounted in an apparatus, for example as illustrated in FIGS. 1 to 4, the transfer belt 6 is stretched over the follower roller 4 and the driving roller 5, and therefore the transfer belt 6 is operated in a state of being stretched to some extent. In example 2, therefore, the surface coat layer 6*b* has a crack occurring elongation percentage larger than five times the elongation percentage of the surface coat layer 6*b* when the transfer belt 6 is being stretched around the follower roller 4 and the driving roller 5 (hereinafter sometime referred to as "elongation percentage when stretched"); that is, the surface coat layer 6*b* is selected such that it must be stretched more than five times the amount it will actually be stretched around the follower roller 4 and the driving roller 5 before cracking will occur.

Figure 7:
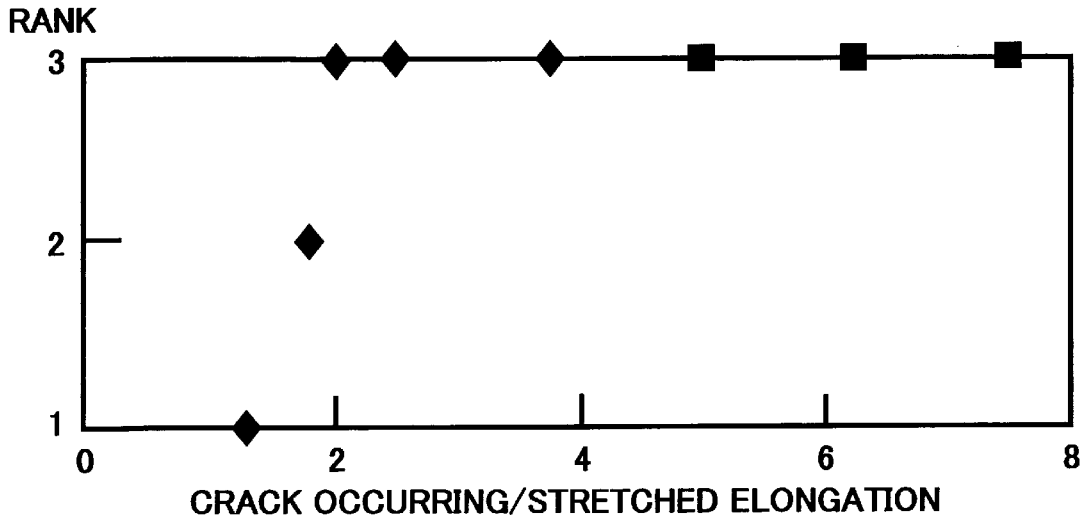
FIG. 7 is a graph illustrating the result of an experiment carried out to investigate the relationship between the ratio of the crack occurring elongation percentage of the transfer belt and the elongation percentage of the belt when the belt is stretched around a group of rollers and the cleaning performance of the belt.

FIG. 7 illustrates the result of an experiment investigating the relationship, in the aforementioned transfer unit 1, between the cleaning performance of the transfer belt 6 and the ratio of the two values of elongation percentage (crack occurring elongation percentage/elongation percentage when stretched) of the surface coat layer 6*b* of the transfer belt 6 and the cleaning performance of the surface of the transfer belt 6. In FIG. 7, the abscissa represents the value of (the crack occurring elongation percentage)/(the elongation percentage when stretched) of the surface coat layer 6*b*. The ordinate represents the result of observation of the cleaning performance of the transfer belt 6: rank 3 represents a satisfactory cleaning performance; rank 2 represents partial presence of defective cleaning; and rank 1 represents defective cleaning (i.e., toner adhesion was observed). Also in FIG. 7, marks "◇" and "■" represent the result of cleaning at respective points of the ratio of the crack occurring elongation percentage/elongation percentage when stretched, of the surface coat layer 6*b*. Mark "◇" indicates that the cleaning performance was decreased with the lapse of time and mark "■" indicates that a satisfactory cleaning performance was obtained even over time.

When considering deterioration of the transfer belt 6 with the lapse of time, such as deterioration at the contact portion with the cleaning member 16A, FIG. 7 suggests that a satisfactory cleaning performance free from toner adhesion can be accomplished over time when the crack occurring elongation percentage of the surface coat layer 6*b* of the transfer belt 6 is larger than five times the elongation percentage of the surface coat layer 6*b* when the belt 6 is stretched. It is thus possible to ensure an appropriate cleaning performance of the transfer belt 6 during the operation by setting the relationship between the crack occurring elongation percentage of the surface coat layer 6*b* and the elongation percentage of the surface coat layer 6*b* when the belt 6 is stretched so as to satisfy the relationship: (crack occurring elongation percentage)>(elongation percentage when stretched)×5.

For example, when the crack occurring elongation of the surface coat layer 6*b* of the transfer belt 6 is 30%, when the belt 6 is stretched around the driving roller 5 and the follower roller 4, the elongation percentage of the transfer belt 6 is preferably set within a range of under 6% for preventing toner adhesion.

When using a surface coat layer having a crack occurring elongation percentage sufficient to prevent toner adhesion from occurring (i.e., an elongation percentage of over 20%) in a transfer belt, as in Example 1, or when setting the elongation percentage of the transfer belt when the transfer belt is stretched over a group of rollers in an operating machine in a range as in Example 2, the surface of the transfer belt 6 would have a frictional coefficient ($\mu$) larger than that of a common transfer belt used conventionally (i.e., a transfer belt having a crack occurring elongation percentage of about 4 to 5%).

If a cleaning blade made of a blade-shaped rubber plate is used as the cleaning member 16A for the transfer belt 6 having a relatively large elongation percentage as in Example 1 or 2 and the leading edge of the cleaning blade is brought into sliding contact with the surface of the transfer belt 6, the frictional force between the cleaning blade and the surface of the transfer belt 6 becomes relatively large as a side effect of the relatively large elongation percentage of the transfer belt 6, which may cause bending of the blade edge of the cleaning blade (hereinafter referred to as "blade bending"), and thereby inconveniences such as defective cleaning of the transfer belt 6 may occur.

EXAMPLE 3

Table 2 shows the result of an experiment carried out in the aforementioned image forming apparatus using various transfer belts 6 to investigate the relationship of the crack occurring elongation percentage of the transfer belt 6, the cleaning performance of the transfer belt 6 (i.e., presence of toner adhesion on the transfer belt 6) and occurrence of blade bending.

TABLE 2

| elongation percentage | cleaning performance | blade bending |
|---|---|---|
| 5 | X | not occurred |
| 7 | Δ | not occurred |
| 8 | ○ | not occurred |
| 10 | ○ | not occurred |
| 15 | ○ | not occurred |
| 20 | ○ | occasionally occurred |
| 25 | ◎ | occurred |
| 30 | ◎ | occurred |

In the column of cleaning performance in Table 2, as in Table 1, "◎" represents non-occurrence of toner adhesion with the lapse of time; "○" represents non-occurrence of toner adhesion for the first 240,000 copies; "Δ" represents occurrence of some cases of toner adhesion; and "X" represents occurrence of toner adhesion from the start.

As is clear from Table 2, when the crack occurring elongation percentage of the transfer belt 6 is larger than 20%, while the transfer belt 6 exhibits a very good cleaning performance even with the lapse of time, there is a tendency toward easy occurrence of blade bending. Accordingly, a blade is not preferable to be used as the cleaning device when the material for the surface coat layer has the crack occurring elongation percentage of over 20%.

In Example 3, therefore, a roller-shaped or brush-shaped cleaning member is used as the cleaning member 16A. As a result, occurrence of defective cleaning of the transfer belt 6 due to the effect of frictional force between the cleaning member 16A and the surface of the transfer belt 6 is prevented. It is consequently possible to use a material having a high crack occurring elongation percentage for a transfer belt 6 for obtaining a good cleaning performance, and thereby a stable cleaning performance of the transfer belt 6 can be accomplished.

Figure 8:
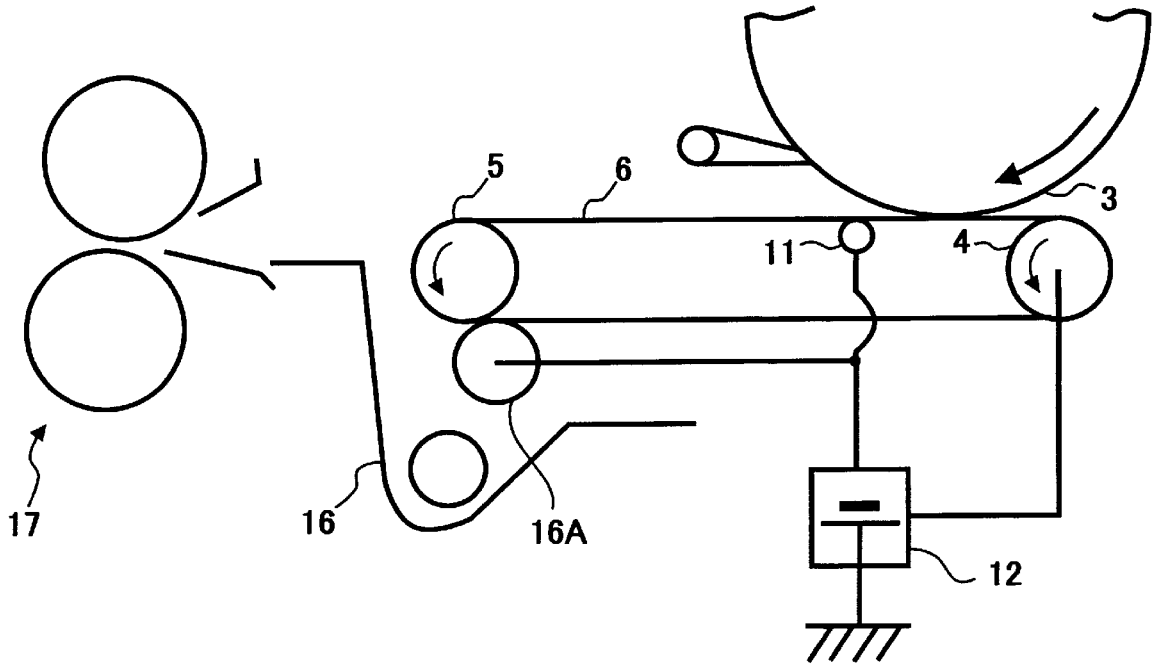
FIG. 8 is a schematic diagram illustrating an example of an image forming apparatus in which a roller-shaped cleaning member is used for the cleaning member of the transfer belt and the cleaning bias applied onto the cleaning roller is voltage-divided from a high-voltage power source for applying a bias onto a bias roller for transfer.

As the above-mentioned roller-shaped cleaning member 16A, a conductive metal roller made of, for example stainless steel, may be used, and toner on the transfer belt 6 is cleaned off by applying onto the metal roller a bias of an inverted polarity to that of toner. As illustrated in FIG. 8, the cleaning bias applied onto the metal roller can be voltage-divided from the high-voltage power source 12. for applying a bias onto the bias roller 11 for transfer.

Figure 9:
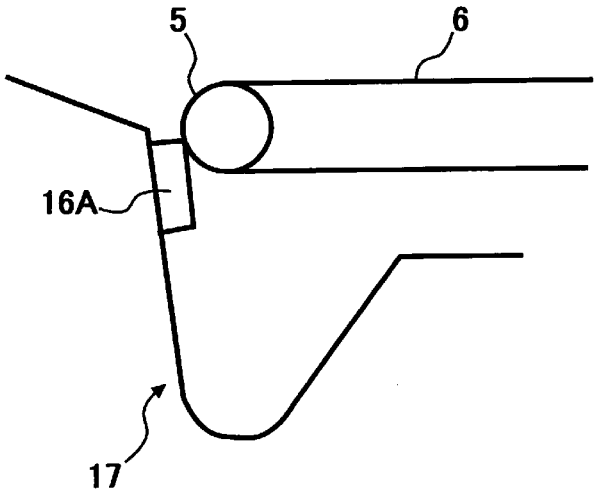
FIG. 9 is a schematic diagram of an example of a brush-shaped cleaning member as the cleaning member of the transfer belt.
Figure 10:
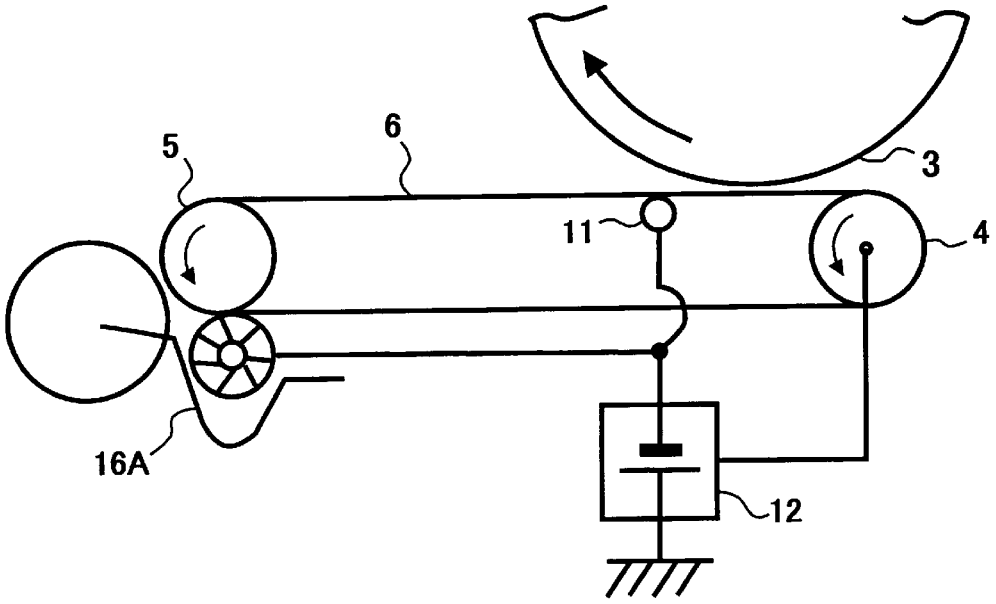
FIG. 10 is a schematic diagram of an example where a fur brush is used as the cleaning member of the transfer belt.

Further, as illustrated in FIGS. 9 and 10, it is also possible to provide a brush-shaped or fur-brush-shaped cleaning member 16A as the cleaning member 16A, and apply a bias of an inverted polarity to that of toner from the power source 12 onto the brush-shaped or fur-brush-shaped cleaning member 16A.

In the image forming apparatus of Examples 1–3, it is desirable to coat a lubricant onto the surface of the transfer belt 6 with a lubricant coating device. By thus coating the surface of the surface coat layer 6*b* of the transfer belt 6 with the lubricant, the cleaning performance of the transfer belt 6 is further improved. Further, as a result of coating of the lubricant onto the transfer belt 6, even when a blade is used as the cleaning member 16A for the transfer belt 6 and even if there is an increase in the frictional coefficient of the surface of the transfer belt 6, blade bending does not occur and thereby occurrence of defective cleaning of the transfer belt 6 is prevented.

Figure 11:
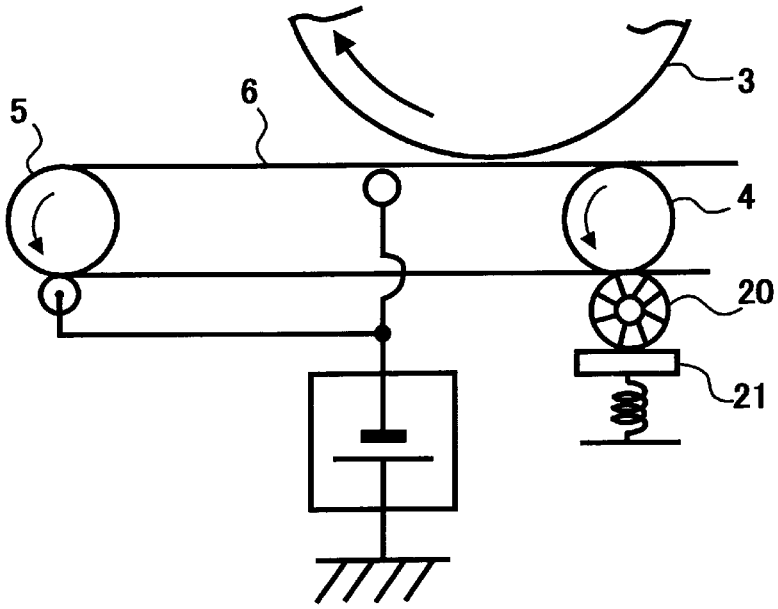
FIG. 11 is a schematic diagram of an image forming apparatus having a lubricant coating device directly coating a lubricant to the transfer belt.
Figure 12:
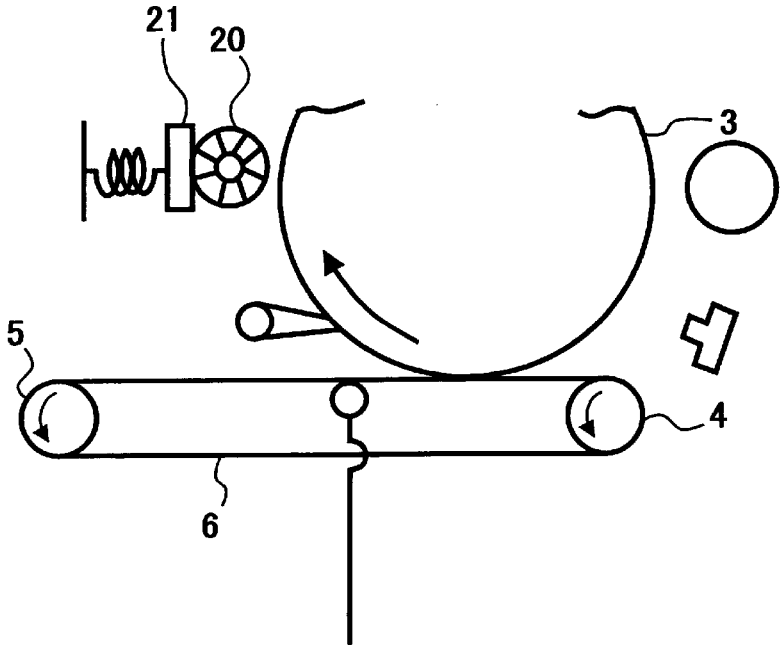
FIG. 12 is a schematic diagram of an image forming apparatus having a lubricant coating device indirectly coating a lubricant to the transfer belt via a photosensitive member.
Figure 13:
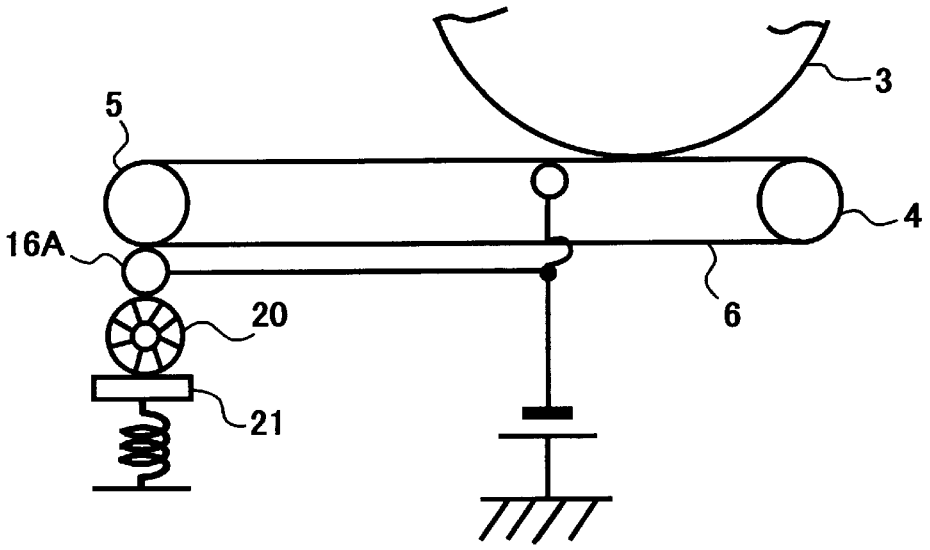
FIG. 13 is a schematic diagram of an image forming apparatus having a lubricant coating device indirectly coating a lubricant to the transfer belt via a cleaning device.

The aforementioned lubricant coating device has a configuration, as illustrated in FIGS. 11 to 13, in which the lubricant 21 is coated onto a rotating brush roller 20 and the lubricant 21 is directly or indirectly coated onto the surface of the transfer belt 6 by the rotating brush roller 20.

FIG. 11 illustrates a case where the lubricant 21 is directly coated onto the surface of the transfer belt 6 by the brush roller 20 serving as the lubricant coating device. FIG. 12 illustrates a case where the lubricant 21 is first coated onto the photosensitive member 3 with the brush roller 20 and then coated onto the surface of the transfer belt 6 via the photosensitive member 3. FIG. 13 illustrates a case where the lubricant 21 is first coated onto the cleaning member 16A with the brush roller 20 and then coated onto the surface of the transfer belt 6 via the cleaning member 16A. The lubricant 21 may be coated onto the surface of the transfer belt 6 when the transfer belt 6 is replaced, or during the operation of an image forming process, or constantly while the power is on. Applicable lubricant 21 materials include zinc stearate, barium stearate, calcium stearate, zinc oleate, manganese oleate and other relatively high-grade fatty acids.

EXAMPLE 4

When the surface coat layer 6*b* having a relatively large elongation percentage is provided on the surface of the transfer belt 6, because the surface coat layer 6*b* tends to easily extend, the frictional coefficient of the surface of the transfer belt 6 tends to be increased and thereby a relatively large frictional force is caused between the surface of the transfer belt 6 and the cleaning member 16A, as described above. As a result, the surface of the surface coat layer 6*b* may be easily smoothed by the cleaning member 16A. When the surface coat layer 6*b* of the transfer belt 6 includes only one layer, if the coat layer 6*b* is smoothed, the base layer 6*a* is exposed. The base layer 6*a* of the transfer belt 6 serving as the undercoat layer of the surface coat layer 6*b* is usually made of an elastic material such as rubber, to which toner or paper powder easily adheres. Particularly in an atmosphere tending to cause a higher surface temperature of the transfer belt 6, not only do toner or paper powder adhere to the transfer belt 6, but the adhered toner melts, resulting in adhesion of the toner or paper powder onto the surface of the transfer belt 6.

Figure 14A:
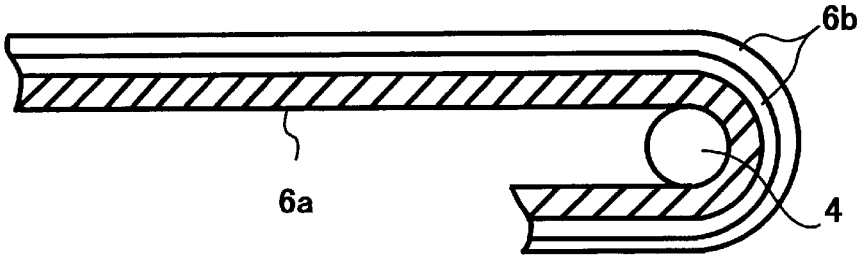
FIG. 14A is a schematic sectional view of another transfer belt used in the aforementioned transfer transport unit.
Figure 14B:
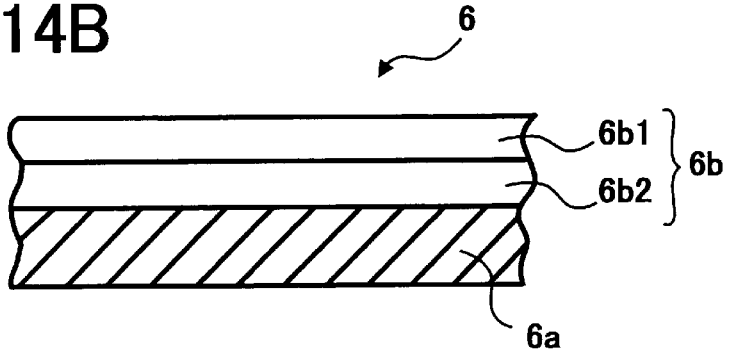
FIG. 14B is a partially enlarged sectional view of the transfer belt.

In Example 4, therefore, as illustrated in FIGS. 14A and 14B, two or more coat layers 6*b* are provided in the transfer belt 6. This makes it possible to further improve the cleaning performance of the transfer belt 6 and also to extend the service life of the transfer belt 6. More specifically, in the transfer belt 6, even if the outermost layer 6*b*1 of the coat layer 6*b* is ground off, because the intermediate layer 6*b*2 is present between the outermost layer 6*b*1 and the base layer 6*a* of the transfer belt 6, toner does not adhere to the base layer 6*a* of the transfer belt 6. Thus, it is possible to further improve the cleaning performance of the transfer belt 6 and to extend the service life thereof by providing two or more coat layers 6*b* in the transfer belt 6 and selecting a material having a crack occurring elongation percentage larger than 20% for at least the outermost layer 6*b*1 of the coat layers 6*b* or setting the crack occurring elongation percentage of at least the outermost layer 6*b*1 of the transfer belt 6 larger than five times the elongation percentage of the outermost layer 6*b*1 of the coat layer 6*b* when the belt 6 is stretched over a group of rollers.

When the surface coat layer 6*b* includes only one layer, the contact surface of the coat layer 6*b* with the base layer (rubber layer) is more susceptible to expansion/contraction force from the base layer (rubber layer) as compared with the outer surface of the coat layer 6*b*. The stress given by the expansion/contraction force propagates to the outer surface of the coat layer 6*b* and cracks may be caused in the outer surface of the surface coat layers 6*b*. This phenomenon becomes more apparent for a larger thickness of the surface coat layers 6*b*. When the surface coat layer 6*b* includes two or more coat layers as described above, in contrast, the intermediate layer 6*b*2 is provided between the outermost layer 6*b*1 and the base layer 6*a* of the transfer belt 6. Since the expansion/contraction force of the base layer (rubber layer) 6*a* is resisted to some extent by the intermediate layer 6*b*2, the expansion/contraction force received by the outer surface of the outermost layer 6*b*1 from the intermediate layer 6*b*2 becomes smaller, thus alleviating the received stress and thereby suppressing occurrence of cracks in the surface of the outermost layer 6*b*1.

EXAMPLE 5

As shown in Table 1, if the crack occurring elongation percentage of the surface coat layer 6*b* is larger than 8%, toner adhesion does not occur in the surface of the transfer belt 6. However, if the crack occurring elongation percentage of the coat layer 6*b* is under 20%, there is a decrease in the cleaning performance of the transfer belt 6 with the lapse of time. Further, when using a cleaning blade as the cleaning device 16A, if the coat layer 6*b* is smoothed with the cleaning blade, the blade edge of the cleaning blade comes into contact with the base layer 6*a* of the coat layer 6*b* and thereby the cleaning blade is worn with the lapse of time.

In Example 5, therefore, in an image forming apparatus including the transfer belt 6 having two or more surface coat layers 6*b*, the crack occurring elongation percentage of the intermediate layer 6*b*2 of the coat layers 6*b* is larger than the crack occurring elongation percentage of the outermost layer 6*b*1. For example, the crack occurring elongation percentage of the outermost layer 6*b*1 is set in a range from 8%, the lower limit as shown in Table 1, for accomplishing a satisfactory cleaning performance, to 20%, the upper limit for avoiding blade bending, and the crack occurring elongation percentage of the intermediate layer 6*b*2 is set larger than 20% or to a value larger than five times the elongation percentage of the intermediate layer 6*b*2 when the belt 6 is stretched around a group of rollers. With this setting, not only is the cleaning performance of the transfer belt 6 improved, but it also becomes possible to use a cleaning blade as the cleaning member 16A because the crack occurring elongation percentage of the outermost layer 6*b*1 of the coat layers 6*b* is smaller than that of the intermediate layer 6*b*2. Further, it is also possible to extend the service life of the blade edge of the cleaning blade.

As described above, by setting the crack occurring elongation percentage of the outermost layer 6*b*1 of the coat layers 6*b* of the transfer belt 6 in the range from 8% to 20%, and the crack occurring elongation percentage of the intermediate layer 6*b*2 of the coat layers 6*b* larger than 20% or to a value larger than five times the elongation percentage of the intermediate layer 6*b*2 when the belt 6 is stretched (i.e., the crack occurring elongation percentage of the intermediate layer 6*b*2 is larger than that of the outermost layer 6*b*1), even if cracks occur in the outermost layer 6*b*1, because cracks do not occur in the intermediate layer 6*b*2, toner or paper powder never adheres to the base layer 6*a* whose temperature tends to be relatively high, and thus a satisfactory cleaning performance of the transfer belt 6 is ensured. Further, contact between the base layer 6*a* of the intermediate layer 6*b*2 and the blade edge of the cleaning blade is avoided, and thereby wear of the blade edge with the lapse of time is prevented and extension of the service life of the cleaning blade is ensured.

EXAMPLE 6

In the example 6, the crack occurring elongation percentage of the outermost layer 6*b*1 of the coat layers 6*b* is set larger than two times and smaller than five times of the elongation percentage of outermost layer 6*b*1 of the transfer belt 6 when the belt 6 is stretched around a group of rollers, and the crack occurring elongation percentage of at least one coat layer of the intermediate layer 6*b*2 of the coat layers 6*b* is set larger than 20%, or to a value larger than five times the elongation percentage of the at least one coat layer of the intermediate layer 6*b*2 when the belt 6 is stretched around the group of rollers.

Figure 15:
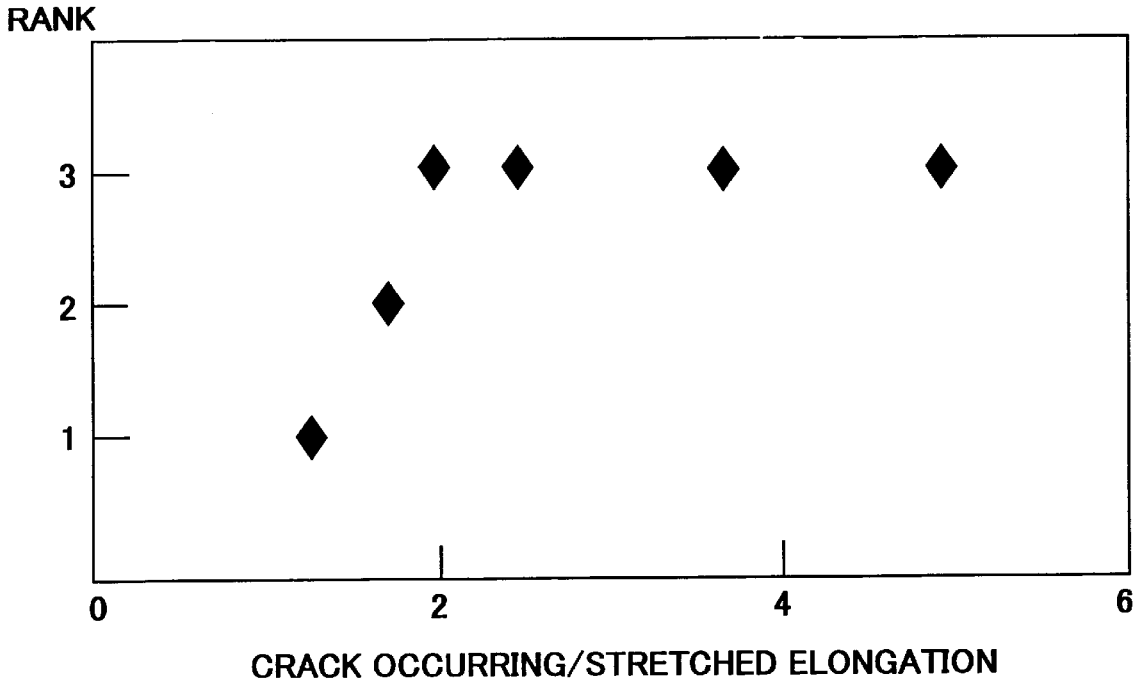
FIG. 15 is a graph illustrating the result of another experiment carried out to investigate the relationship between the ratio of the crack occurring elongation percentage of the transfer belt and the elongation percentage of the belt when the belt is stretched around a group of rollers and the cleaning performance of the belt.
Figure 16:
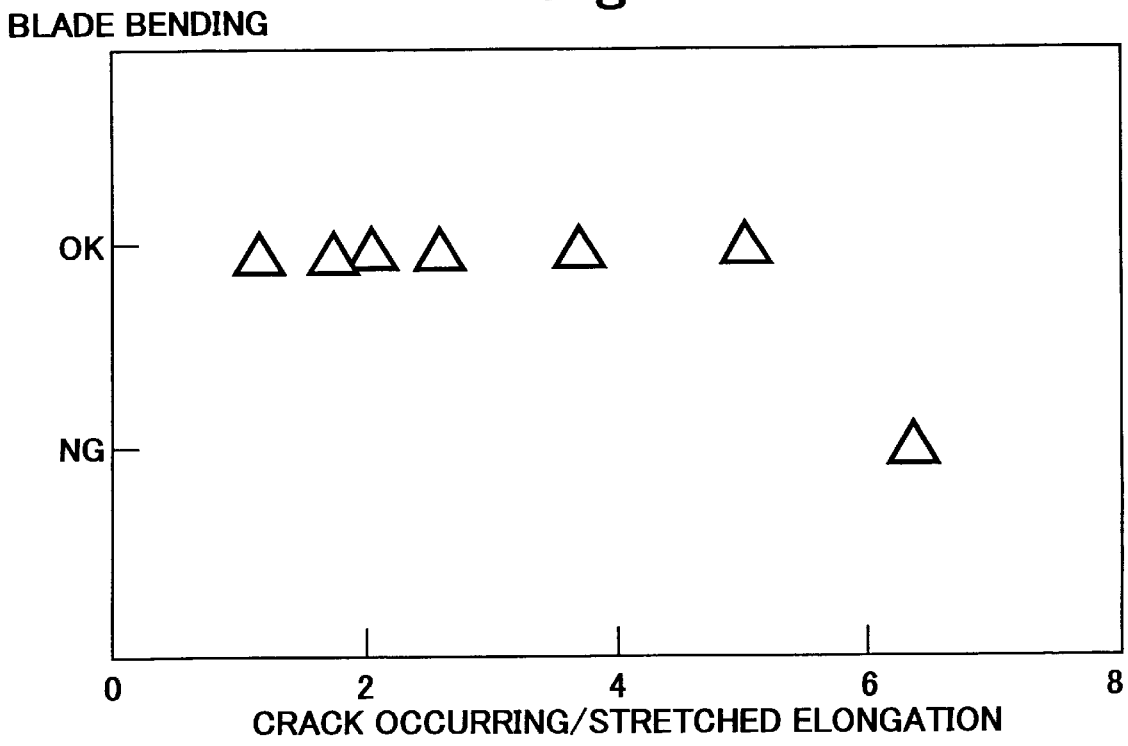
FIG. 16 is a graph illustrating the result of another experiment carried out to investigate the relationship between the ratio of the crack occurring elongation percentage of the transfer belt and the elongation percentage of the belt when the belt is stretched around a group of rollers and bending of the blade of a cleaning member.

The crack occurring elongation percentage of the outermost layer 6*b*1 of the coat layers 6*b* is determined based upon the two graphs shown in FIGS. 15 and 16, the lower limit being determined so as to accomplish a satisfactory cleaning performance and the upper limit being determined so as to avoid occurrence of blade bending. More specifically, FIGS. 15 and 16 illustrate the result of investigating the relationship of the aforementioned ratio of elongation percentage (crack occurring elongation percentage/elongation percentage when stretched) of the outermost layer 6*b*1, the cleaning performance of the surface of the transfer belt 6, and the presence of blade bending. The ordinate in FIG. 15 represents the result of observation of the cleaning performance of the transfer belt 6: rank 3 shows a satisfactory cleaning performance; rank 2 shows partial defective cleaning; and rank 1, defective cleaning (toner adhesion observed). In FIG. 15, mark "◇" represents the result of observation at each measuring point.

In the above-mentioned Examples 5 and 6, because occurrence of blade bending is prevented, a blade-shaped cleaning member can be used as the cleaning member 16A.

EXAMPLE 7

In Example 7, an endless belt having a configuration described in one of the above Examples is applied to a sheet transporting device which transports a transfer medium in a non-contact state with a photosensitive member as an image carrier in an image forming apparatus.

Figure 17A:
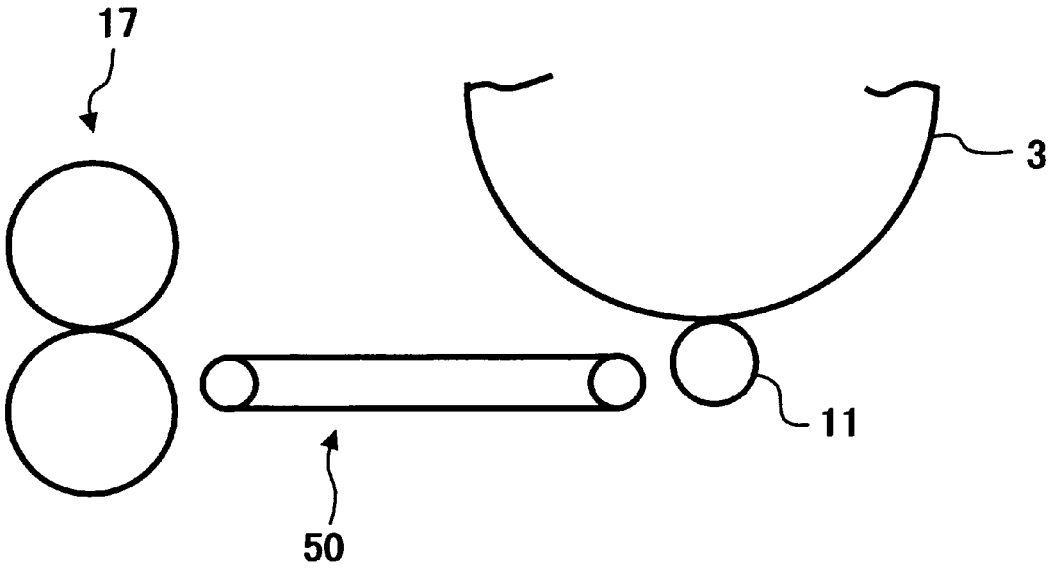
FIGS. 17A and 17B are schematic diagrams of an image forming apparatus according to another embodiment of the present invention.
Figure 17B:
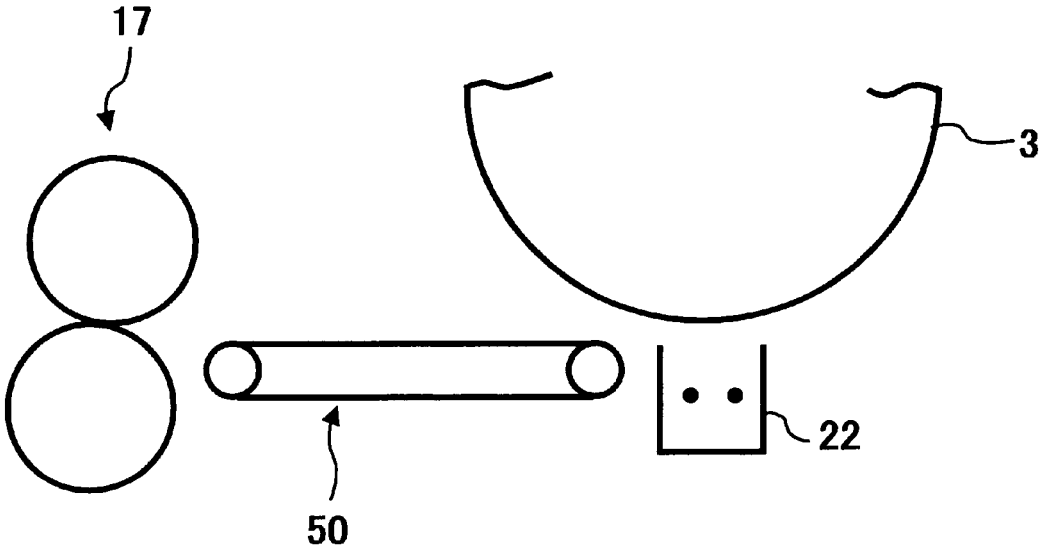

FIGS. 17A and 17B illustrate examples of configuration of an image forming apparatus using a sheet transporting device 50 to transport a transfer medium to a fixing unit 17. In the example illustrated in FIG. 17A, a transfer roller is used as a transfer device to transfer a toner image to a transfer medium from a photosensitive member 3, and in the example illustrated in FIG. 17B a corona charger 22 is used as the transfer device. The endless belt-shaped sheet transporting device 50 is arranged between the transfer roller 11 or the corona charger 22 serving as the transfer device and the fixing unit 17. The sheet transporting device 50 carries thereon a transfer medium having received a transferred toner image on the upper surface thereof and transports the carried transfer medium to the fixing unit 17. The sheet transporting device 50 does not contact the photosensitive member 3. In Example 7, the belt described in one of the preceding Examples is adopted for the endless belt forming the sheet transporting device 50.

In the above-mentioned Examples 1–7, measurement of the amount of wear of the edge of the cleaning blade 16A demonstrated that, when using the transfer belt 6 having a satisfactory cleaning performance, the amount of wear of the edge of the cleaning blade 16A was suppressed within a range of from 0.5 to 5 $\mu$m, thus improving the service life of the cleaning blade as compared with conventional cases. When using the transfer belt 6 in which cracks have occurred in the belt 6 and resulting defective cleaning was observed, on the other hand, the amount of wear of the edge of the cleaning blade 16A was within a range of from 8 to 15 $\mu$m. Thus, it is possible to improve the service life of a cleaning blade and to reduce the running cost of a transfer unit including a transfer medium transport system as a whole and an image forming apparatus including the transfer unit as a whole, by reducing the amount of wear of the edge of the cleaning blade 16A.

According to the embodiments of the present invention, as described above, it is possible to satisfactorily clean off toner on the surface of the transfer belt 6 and prevent toner adhesion on the surface thereof. It is therefore possible to prevent defective charging of a photosensitive member or back contamination of a transfer sheet attributable to defective cleaning of the transfer belt 6, and prevent jamming of the transfer sheet caused by toner adhesion on the surface of the transfer belt 6.

Also according to the embodiments of the present invention, it is possible to reduce the amount of wear of a cleaning blade cleaning the surface of the transfer belt 6, and thus to improve the service life of the cleaning blade.

According to the embodiments of the present invention, furthermore, it is possible to easily remove foreign materials such as paper powder produced from transfer sheets and adhering to the surface of the transfer belt 6 with a cleaning blade. It is therefore not necessary to provide a member such as a paper powder removing miller as in a conventional apparatus, thus leading to cost reduction of the apparatus.

The present invention is applicable any image forming apparatus without being limited to the configurations of the image forming apparatus illustrated in FIGS. 1 to 6, except for the surface configuration of the transfer belt 6, giving similar effects in all cases.

For example, while a bias roller 11 onto which a transfer bias voltage is applied is used as a transfer charge applying device in the above-mentioned examples, a transfer charger 22 as illustrated in FIG. 17B, or a brush member including fibers made by blending a conductive material such as carbon to a main material such as acryl, nylon, polyester or polypropylene may be used in place of the roller 11.

Further, the position of installing a transfer charge applying device may be either downstream or upstream of a transfer nip section in the belt moving direction, or may be in the transfer nip section.

FIG. 14 illustrates a case where a three-layer-structured transfer belt 6 is used. The present invention is however applicable also to a transfer belt of four or more layers.

Further, the present invention is applicable irrespective of the charge polarity of toner and a photosensitive member, and the developing method, such as a reversal or normal developing method.

In the above-mentioned examples, a case where a single bias roller 11 is provided as the transfer charge applying device has been described. The invention is also applicable to a case where a plurality of transfer charge applying devices are provided.

In the above-mentioned examples, a case where a toner image is directly transferred onto a transfer sheet S carried on the transfer belt 6 from the photosensitive member 6 has been described. The present invention is applicable also to an image forming apparatus such as a color printer or a color copy machine, in which a toner image formed on an image carrier is once transferred to an intermediate transfer member and the transferred image is then transferred to a transfer sheet. Specifically, the present invention is applicable to such color printer or color copying machine including a latent image forming device for forming a latent image on a latent image carrier such as a drum-shaped photosensitive member, a developing device for developing the latent image on the latent image carrier with toner, a transfer device for transferring the toner image on the latent image carrier onto an intermediate transfer medium such as an intermediate transfer belt serving as an image carrier, and a transfer unit for transferring the toner image on the intermediate transfer medium onto a transfer medium on the transfer medium carrier.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent applications Nos. 11-045561 and 11-215968 filed in the Japanese Patent Office on Feb. 23, 1999 and Jul. 29, 1999, respectively, and the entire contents of which are hereby incorporated by reference.

What is claimed as new and is desired to be secured by Letters Patent of the United States:

1. An image forming apparatus comprising:

an image carrier; and a transfer device arranged in proximity to the image carrier to transfer a toner image on the image carrier onto a transfer medium, the transfer device including an endless transfer member having a substrate made of an elastic material and a surface coat layer on the substrate, the surface coat layer having a crack occurring elongation percentage larger than 8%.

2. An image forming apparatus according to claim 1, wherein said endless transfer member is belt shaped.

3. An image forming apparatus according to claim 1, wherein said endless transfer member is roller shaped.

4. An image forming apparatus according to claim 1, wherein said transfer device includes a transfer member cleaning device, said cleaning device including a conductive roller-shaped member.

5. An image forming apparatus according to claim 1, wherein said transfer device includes a transfer member cleaning device, said cleaning device including a brush roller.

6. An image forming apparatus according to claim 1, wherein said transfer device includes a transfer member cleaning device, said cleaning device including a brush.

7. An image forming apparatus according to claim 1, further comprising a lubricant coating device positioned for coating a lubricant to at least one of said image carrier and said endless transfer member.

8. An image forming apparatus comprising:

an image carrier; and a transfer device arranged in proximity to the image carrier to transfer a toner image on the image carrier onto a transfer medium, the transfer device including an endless transfer member comprising a belt including a substrate made of an elastic material and a surface coat layer formed on the substrate, wherein a relationship between a crack occurring elongation percentage of the surface coat layer of the belt and an elongation percentage of the surface coat layer when the belt is stretched around a group of rollers is set so as to satisfy a condition expressed by (the crack occurring elongation percentage)>(the elongation percentage when the belt is stretched)×5.

9. An image forming apparatus according to claim 8, wherein said transfer device includes a transfer member cleaning device, and said cleaning device includes a conductive roller-shaped member.

10. An image forming apparatus according to claim 8, wherein said transfer device includes a transfer member cleaning device, and said cleaning device includes a brush roller.

11. An image forming apparatus according to claim 8, wherein said transfer device includes a transfer member cleaning device, and said cleaning device includes a brush.

12. An image forming apparatus according to claim 8, further comprising a lubricant coating device positioned for coating a lubricant onto at least one of said image carrier and said endless transfer member.

13. An image forming apparatus comprising:

an image carrier; and a transfer device arranged in proximity to the image carrier to transfer a toner image on the image carrier onto a transfer medium, the transfer device including an endless transfer member comprising a belt having a substrate made of an elastic material and a surface coat layer formed on said substrate, wherein said surface coat layer includes an outermost layer and at least one intermediate layer, and wherein at least one of a first condition that a crack occurring elongation percentage of the outermost layer of the belt is larger than 20% and a second condition that a relationship between the crack occurring elongation percentage of the outermost layer of the belt and an elongation percentage of the outermost layer when the belt is stretched around a group of rollers satisfies a condition expressed by (the crack occurring elongation percentage)>(the elongation percentage when the belt is stretched)×5 is satisfied.

14. An image forming apparatus according to claim 13, wherein a crack occurring elongation percentage of said at least one intermediate layer is larger than the crack occurring elongation percentage of said outermost layer.

15. An image forming apparatus according to claim 13, wherein said transfer device includes a transfer member cleaning device, and said cleaning device includes a conductive roller-shaped member.

16. An image forming apparatus according to claim 13, wherein said transfer device includes a transfer member cleaning device, and said cleaning device includes a brush roller.

17. An image forming apparatus according to claim 13, wherein said transfer device includes a transfer member cleaning device, and said cleaning device includes a brush.

18. An image forming apparatus according to claim 13, further comprising a lubricant coating device positioned for coating a lubricant to at least one of said image carrier and said endless transfer member.

19. An image forming apparatus according to claim 13, wherein the transfer device includes a transfer member cleaning device, and said cleaning device includes a cleaning blade positioned for cleaning said endless transfer member.

20. An image forming apparatus comprising:

an image carrier; and a transfer device arranged in proximity to the image carrier to transfer a toner image on the image carrier onto a transfer medium, the transfer device including an endless transfer member comprising a belt having a substrate made of an elastic material, and a surface coat layer formed on said substrate, wherein said surface coat layer includes an outermost layer and at least one intermediate layer, a crack occurring elongation percentage of said outermost layer is in a range from 8% to 20%, and wherein at least one of a first condition that a crack occurring elongation percentage of said at least one intermediate layer is larger than 20% and a second condition that a relationship between the crack occurring elongation percentage of said at least one intermediate layer and an elongation percentage of said at least one intermediate layer when the belt is stretched around a group of rollers satisfies a condition expressed by (the crack occurring elongation percentage)>(the elongation percentage when the belt is stretched)×5 is satisfied.

21. An image forming apparatus according to claim 20, wherein the transfer device includes a transfer member cleaning device, and said cleaning device includes a cleaning blade positioned for cleaning said endless transfer member.

22. An image forming apparatus comprising:

an image carrier; and a transfer device arranged in proximity to the image carrier to transfer a toner image on the image carrier onto a transfer medium, the transfer device including an endless transfer member comprising a belt having a substrate made of an elastic material, and a surface coat layer formed on said substrate, wherein said surface coat layer includes an outermost layer and at least one intermediate layer, and wherein a relationship between a crack occurring elongation percentage of said outermost layer and an elongation percentage of said outermost layer when the belt is stretched around a group of rollers satisfies a condition expressed by (the elongation percentage when the belt is stretched)×2≦(the crack occurring elongation percentage)≦(the elongation percentage when the belt is stretched)×5, and at least one of a first condition that a crack occurring elongation percentage of said at least one intermediate layer is larger than 20% and a second condition that an elongation percentage of said intermediate layer when the belt is stretched around a group of rollers satisfies a condition expressed by (the crack occurring elongation percentage)>(the elongation percentage when the belt is stretched)×5 is satisfied.

23. An image forming apparatus according to claim 22, wherein the transfer device includes a transfer member cleaning device, and said cleaning device includes a cleaning blade positioned for cleaning said endless transfer member.

24. An image forming apparatus comprising:

an image carrier; and a sheet transporting device arranged in proximity to the image carrier to transport a transfer sheet carrying a toner image transferred from the image carrier, the transporting device including an endless transporting member comprising a substrate made of an elastic material and a surface coat layer formed on the substrate, wherein a crack occurring elongation percentage of said surface coat layer is larger than 20%.

25. An image forming apparatus according to claim 24, wherein said endless transporting member is belt shaped.

26. An image forming apparatus according to claim 24, wherein said endless transporting member is roller shaped.

27. An image forming apparatus according to claim 24, wherein said transporting member includes a transporting member cleaning device, and said cleaning device includes a conductive roller-shaped member.

28. An image forming apparatus according to claim 24, wherein said transporting member includes a transporting member cleaning device, and said cleaning device includes a brush roller.

29. An image forming apparatus according to claim 24, wherein said transporting member includes a transporting member cleaning device, and said cleaning device includes a brush.

30. An image forming apparatus according to claim 24, further comprising a lubricant coating device positioned for coating a lubricant onto at least one of said image carrier and said endless transporting member.

31. An image forming apparatus comprising:

an image carrier; and a sheet transporting device arranged in a proximity to the image carrier to transport a transfer sheet carrying a toner image transferred from the image carrier, the transporting device including an endless transporting member comprising belt having a substrate made of an elastic material, and a surface coat layer formed on the substrate, wherein a relationship between a crack occurring elongation percentage of the surface coat layer of the belt and an elongation percentage of the surface coat layer when the belt is stretched around a group of rollers is set so as to satisfy a condition expressed by (the crack occurring elongation percentage)>(the elongation percentage when the belt is stretched)×5.

32. An image forming apparatus according to claim 31, wherein said sheet transporting device includes a transporting member cleaning device, and said cleaning device includes a conductive roller-shaped member.

33. An image forming apparatus according to claim 31, wherein said sheet transporting device includes a transporting member cleaning device, and said cleaning device includes a brush roller.

34. An image forming apparatus according to claim 31, wherein said sheet transporting device includes a transporting member cleaning device, and said cleaning device includes a brush.

35. An image forming apparatus according to claim 31, further comprising a lubricant coating device positioned for coating a lubricant to at least one of said image carrier and said endless transporting member.

36. An image forming apparatus comprising:

an image carrier; and a sheet transporting device arranged in proximity to the image carrier to transport a transfer sheet carrying a toner image transferred from the image carrier, the transporting device including an endless transporting member comprising a belt formed of a substrate made of an elastic material and having a surface coat layer formed on the substrate, wherein said surface coat layer includes an outermost layer and at least one intermediate layer, wherein a crack occurring elongation percentage of the outermost layer of the belt is larger than 20%, and a relationship between the crack occurring elongation percentage of the outermost layer of the belt and an elongation percentage of the outermost layer when the belt is stretched around a group of rollers satisfies a condition expressed by (the crack occurring elongation percentage)>(the elongation percentage when the belt is stretched)×5.

37. An image forming apparatus according to claim 36, wherein a crack occurring elongation percentage of said at least one intermediate layer is larger than the crack occurring elongation percentage of said outermost layer.

38. An image forming apparatus according to claim 36, wherein said sheet transporting device includes a transporting member cleaning device, and said cleaning device includes a conductive roller-shaped member.

39. An image forming apparatus according to claim 36, wherein said sheet transporting device includes a transporting member cleaning device, and said cleaning device includes a brush roller.

40. An image forming apparatus according to claim 36, wherein said sheet transporting device includes a transporting member cleaning device, and said cleaning device includes a brush.

41. An image forming apparatus according to claim 36, further comprising a lubricant coating device positioned for coating a lubricant to at least one of said image carrier and said endless transporting member.

42. An image forming apparatus comprising:

an image carrier; and a sheet transporting device arranged in proximity to the image carrier to transport a transfer sheet carrying a toner image transferred from the image carrier, the transporting device including an endless transporting member comprising a belt having a substrate made of an elastic material, and a surface coat layer formed on said substrate, wherein said surface coat layer includes an outermost layer and at least one intermediate layer, a crack occurring elongation percentage of said outermost layer is in a range from 8% to 20%, and at least one of a first condition that a crack occurring elongation percentage of said at least one intermediate layer is larger than 20% and a second condition that a relationship between the crack occurring elongation percentage of said at least one intermediate layer and an elongation percentage of said at least one intermediate layer when the belt is stretched around a group of rollers satisfies a condition expressed by (the crack occurring elongation percentage)>(the elongation percentage when the belt is stretched)×5 is satisfied.

43. An image forming apparatus according to claim 42, wherein said sheet transporting device includes a transporting member cleaning device, and wherein the cleaning device includes a cleaning blade positioned for cleaning said endless transporting member.

44. An image forming apparatus comprising:

an image carrier; and a sheet transporting device arranged proximity to the image carrier to transport a transfer sheet carrying a toner image transferred from the image carrier, the transporting device including an endless transporting member comprising a belt having a substrate made of an elastic material, and a surface coat layer formed on said substrate, wherein said surface coat layer includes an outermost layer and at least one intermediate layer, wherein a relationship between a crack occurring elongation percentage of said outermost layer and an elongation percentage of said outermost layer when the belt is stretched around a group of rollers satisfies a condition expressed by (the elongation percentage when the belt is stretched)×2≦(the crack occurring elongation percentage)≦(the elongation percentage when the belt is stretched)×5, and at least one of a first condition that a crack occurring elongation percentage of said at least one intermediate layer is larger than 20% and a second condition that an elongation percentage of said intermediate layer when the belt is stretched around a group of rollers satisfies a condition expressed by (the crack occurring elongation percentage)>(the elongation percentage when the belt is stretched)×5 is satisfied.

45. An image forming apparatus according to claim 44, wherein said sheet transporting device includes a transporting member cleaning device, and the cleaning device includes a cleaning blade positioned for cleaning said endless transporting member.

46. An image forming apparatus comprising:

an image carrier; and an intermediate transfer device arranged in proximity to the image carrier to transfer a toner image on the image carrier thereupon so as to transfer the toner image onto a transfer sheet, the transfer device including an endless intermediate transfer member comprising a substrate made of an elastic material, and a surface coat layer formed on said substrate, wherein a crack occurring elongation percentage of said surface coat layer is larger than 20%.

47. An image forming apparatus according to claim 46, wherein said endless intermediate transfer member is belt shaped.

48. An image forming apparatus according to claim 46, wherein said endless intermediate transfer member is roller shaped.

49. An image forming apparatus according to claim 46, wherein said intermediate transfer device comprises an endless intermediate transfer member cleaning device, wherein said cleaning device includes a conductive roller-shaped member.

50. An image forming apparatus according to claim 46, wherein said intermediate transfer device comprises an endless intermediate transfer member cleaning device, wherein said cleaning device includes a brush roller.

51. An image forming apparatus according to claim 46, wherein said intermediate transfer device comprises an endless intermediate transfer member cleaning device, wherein said cleaning device includes a brush.

52. An image forming apparatus according to claim 46, further comprising a lubricant coating device positioned for coating a lubricant to at least one of said image carrier and said endless intermediate transfer member.

53. An image forming apparatus comprising:

an image carrier; and an intermediate transfer device arranged in proximity to the image carrier to transfer a toner image on the image carrier thereupon so as to transfer the toner image onto a transfer sheet, the transfer device including an endless intermediate transfer member comprising a belt made of an elastic material, and a surface coat layer formed on a substrate, wherein a relationship between a crack occurring elongation percentage of the surface coat layer of the belt and an elongation percentage of the surface coat layer when the belt is stretched around a group of rollers is set so as to satisfy a condition expressed by (the crack occurring elongation percentage)>(the elongation percentage when the belt is stretched)×5.

54. An image forming apparatus according to claim 53, wherein said intermediate transfer device comprises an endless intermediate transfer member cleaning device, wherein said cleaning device includes a conductive roller-shaped member.

55. An image forming apparatus according to claim 53, wherein said intermediate transfer device comprises an endless intermediate transfer member cleaning device, wherein said cleaning device includes a brush roller.

56. An image forming apparatus according to claim 53, wherein said intermediate transfer device comprises an endless intermediate transfer member cleaning device, wherein said cleaning device includes a brush.

57. An image forming apparatus according to claim 53, further comprising a lubricant coating device positioned for coating a lubricant to at least one of said image carrier and said endless intermediate transfer member.

58.An image forming apparatus comprising:

an image carrier; and an intermediate transfer device arranged in proximity of the image carrier to transfer a toner image on the image carrier thereupon so as to transfer the toner image onto a transfer sheet, the transfer device including an endless intermediate transfer member comprising a belt formed on a substrate made of an elastic material, and a surface coat layer formed on said substrate, wherein said surface coat layer includes an outermost layer and at least one intermediate layer, and at least one of a first condition that a crack occurring elongation percentage of the outermost layer of the belt is larger than 20% and a second condition that a relationship between the crack occurring elongation percentage of the outermost layer of the belt and an elongation percentage of the outermost layer when the belt is stretched around a group of rollers satisfies a condition expressed by (the crack occurring elongation percentage)>(the elongation percentage when the belt is stretched)×5 is satisfied.

59. An image forming apparatus according to claim 58, wherein a crack occurring elongation percentage of said at least one intermediate layer is larger than the crack occurring elongation percentage of said outermost layer.

60. An image forming apparatus according to claim 58, wherein said intermediate transfer device comprises an endless intermediate transfer member cleaning device, wherein said cleaning device includes a conductive roller-shaped member.

61. An image forming apparatus according to claim 58, wherein said intermediate transfer device comprises an endless intermediate transfer member cleaning device, wherein said cleaning device includes a brush roller.

62. An image forming apparatus according to claim 58, wherein said intermediate transfer device comprises an endless intermediate transfer member cleaning device, wherein said cleaning device includes a brush.

63. An image forming apparatus according to claim 58, further comprising a lubricant coating device positioned for coating a lubricant onto at least one of said image carrier and said endless intermediate transfer member.

64. An image forming apparatus comprising:

an image carrier; and an intermediate transfer device arranged in proximity to the image carrier to transfer a toner image on the image carrier thereupon so as to transfer the toner image onto a transfer sheet, the transfer device including an endless intermediate transfer member comprising a belt formed of a substrate made of an elastic material, and a surface coat layer formed on said substrate, wherein said surface coat layer includes an outermost layer and at least one intermediate layer, a crack occurring elongation percentage of said outermost layer is in a range from 8% to 20%, and at least one of a first condition that a crack occurring elongation percentage of said at least one intermediate layer is larger than 20% and a second condition that a relationship between the crack occurring elongation percentage of said at least one intermediate layer and an elongation percentage of said at least one intermediate layer when the belt is stretched around a group of rollers satisfies a condition expressed by (the crack occurring elongation percentage)>(the elongation percentage when the belt is stretched)×5 is satisfied.

65. An image forming apparatus according to claim 64, wherein said intermediate transfer device comprises an endless intermediate transfer member cleaning device, wherein the cleaning device includes a cleaning blade positioned for cleaning said endless intermediate transfer member.

66. An image forming apparatus comprising:

an image carrier; and an intermediate transfer device arranged in proximity to the image carrier to transfer a toner image on the image carrier thereupon so as to transfer the toner image onto a transfer sheet, the transfer device including an endless intermediate transfer member comprising a belt formed of a substrate made of an elastic material, and a surface coat layer formed on said substrate, wherein said surface coat layer includes an outermost layer and at least one intermediate layer, wherein a relationship between a crack occurring elongation percentage of said outermost layer and an elongation percentage of said outermost layer when the belt is stretched around a group of rollers satisfies a condition expressed by (the elongation percentage when the belt is stretched)×2≦(the crack occurring elongation percentage)≦(the elongation percentage when the belt is stretched)×5, and at least one of a first condition that a crack occurring elongation percentage of said at least one intermediate layer is larger than 20% and a second condition that an elongation percentage of said intermediate layer when the belt is stretched around a group of rollers satisfies a condition expressed by (the crack occurring elongation percentage)>(the elongation percentage when the belt is stretched)×5 is satisfied.

67. An image forming apparatus according to claim 66, wherein said intermediate transfer device comprises an endless intermediate transfer member cleaning device, wherein the cleaning device includes a cleaning blade positioned for cleaning said endless intermediate transfer member.

68. An image forming apparatus comprising:

an image carrier; and means including an endless transfer member for transferring a toner image on the image carrier onto a transfer medium, wherein said endless transfer member has a substrate made of an elastic material, and a surface coat layer formed on said substrate, wherein a crack occurring elongation percentage of said surface coat layer is larger than 20%.

69. An image forming apparatus comprising:

an image carrier; and means including an endless transfer member for transferring a toner image on the image carrier onto a transfer medium, wherein said endless transfer member comprises a belt having a substrate made of an elastic material, and a surface coat layer formed on said substrate, and wherein a relationship between a crack occurring elongation percentage of the surface coat layer of the belt and an elongation percentage of the surface coat layer when the belt is stretched around a group of rollers is set so as to satisfy a condition expressed by (the crack occurring elongation percentage)>(the elongation percentage when the belt is stretched)×5.

70. An image forming apparatus comprising:

an image carrier; and means including an endless transfer member for transferring a toner image on the image carrier onto a transfer medium, wherein said endless transfer member is a belt having a substrate made of an elastic material, and a surface coat layer formed on said substrate, wherein said surface coat layer includes an outermost layer and at least one intermediate layer, and one of a first condition that a crack occurring elongation percentage of the outermost layer of the belt is larger than 20% and a second condition that a relationship between the crack occurring elongation percentage of the outermost layer of the belt and an elongation percentage of the outermost layer when the belt is stretched around a group of rollers satisfies a condition expressed by (the crack occurring elongation percentage)>(the elongation percentage when the belt is stretched) is satisfied.

71. An image forming apparatus comprising:

an image carrier; and means including an endless transfer member for transferring a toner image on the image carrier onto a transfer medium, wherein said endless transfer member comprises a belt having a substrate made of an elastic material, and a surface coat layer formed on said substrate, wherein said surface coat layer includes an outermost layer and at least one intermediate layer, a crack occurring elongation percentage of said outermost layer is in a range from 8% to 20%, and at least one of a first condition that a crack occurring elongation percentage of said at least one intermediate layer is larger than 20% and a second condition that a relationship between the crack occurring elongation percentage of said at least one intermediate layer and an elongation percentage of said at least one intermediate layer when the belt is stretched around a group of rollers satisfies a condition expressed by (the crack occurring elongation percentage)>(the elongation percentage when the belt is stretched)×5 is satisfied.

72. An image forming apparatus comprising:

an image carrier; and means including an endless transfer member for transferring a toner image on the image carrier onto a transfer medium, wherein said endless transfer member comprises a belt having a substrate made of an elastic material, and a surface coat layer formed on said substrate, wherein said surface coat layer includes an outermost layer and at least one intermediate layer, a relationship between a crack occurring elongation percentage of said outermost layer and an elongation percentage of said outermost layer when the belt is stretched around a group of rollers satisfies a condition expressed by (the elongation percentage when the belt is stretched)×2≦(the crack occurring elongation percentage)≦(the elongation percentage when the belt is stretched)×5, and at least one of a first condition that a crack occurring elongation percentage of said at least one intermediate layer is larger than 20% and a second condition that an elongation percentage of said intermediate layer when the belt is stretched around a group of rollers satisfies a condition expressed by (the crack occurring elongation percentage)>(the elongation percentage when the belt is stretched)×5 is satisfied.

* * * * *